US012108848B2

(12) United States Patent
Myerscough et al.

(10) Patent No.: US 12,108,848 B2
(45) Date of Patent: Oct. 8, 2024

(54) SLIDE FASTENER SEALING SYSTEMS AND METHODS

(71) Applicant: YKK (U.S.A.) Inc., Marietta, GA (US)

(72) Inventors: Richard Kerr Myerscough, Victoria (CA); Ross Davis Harrington, Victoria (CA)

(73) Assignee: YKK (U.S.A.) Inc., Marietta, GA (US)

( * ) Notice: Subject to any disclaimer, the term of this patent is extended or adjusted under 35 U.S.C. 154(b) by 0 days.

(21) Appl. No.: 18/031,775

(22) PCT Filed: Jan. 14, 2022

(86) PCT No.: PCT/US2022/012474
§ 371 (c)(1),
(2) Date: Apr. 13, 2023

(87) PCT Pub. No.: WO2022/169577
PCT Pub. Date: Aug. 11, 2022

(65) Prior Publication Data

US 2023/0389660 A1 Dec. 7, 2023

Related U.S. Application Data

(60) Provisional application No. 63/145,087, filed on Feb. 3, 2021.

(51) Int. Cl.
*A44B 19/32* (2006.01)
*A44B 19/06* (2006.01)

(52) U.S. Cl.
CPC ..... *A44B 19/32* (2013.01); *A44B 19/06* (2013.01)

(58) Field of Classification Search
CPC ..... A44B 19/32; A44B 19/301; A44B 19/06; A44B 19/02
See application file for complete search history.

(56) References Cited

U.S. PATENT DOCUMENTS 2,615,224 A * 10/1952 Shur ..... A44B 19/32 24/384
2,693,013 A * 11/1954 Gossner ..... A44B 19/26 24/384
2,746,114 A * 5/1956 Williams ..... A44B 19/32 285/260
3,102,570 A 3/1963 Fairchilds
(Continued)

OTHER PUBLICATIONS

International Search Report and Written Opinion, PCT Patent Application No. PCT/US2022/012474, Apr. 7, 2022, 11 pages.
(Continued)

*Primary Examiner* — Robert Sandy
(74) *Attorney, Agent, or Firm* — Kilpatrick Townsend & Stockton LLP

(57) ABSTRACT

A slide fastener sealing system and related methods. In one example, the slide fastener sealing system includes a separating slide fastener in which a first end overlaps and is secured to a second end such that a sealing zone is located between the overlapping ends of the slide fastener. The sealing system also includes in this example a sealing member that can be secured to the slide fastener in a removable fashion with a portion of the sealing member located in the sealing zone to seal against fluid penetration through the sealing zone.

24 Claims, 24 Drawing Sheets

(56) References Cited

U.S. PATENT DOCUMENTS

| | | | | |
|---|---|---|---|---|
| 6,223,349 | B1 * | 5/2001 | Roiser | A44B 19/32 2/82 |
| 11,033,081 | B2 * | 6/2021 | Myerscough | A44B 19/32 |
| 11,116,291 | B2 * | 9/2021 | Myerscough | A44B 19/36 |
| 11,744,331 | B2 * | 9/2023 | Myerscough | A44B 19/36 24/415 |
| 2020/0196717 | A1 | 6/2020 | Myerscough et al. | |

OTHER PUBLICATIONS

Commercial Item Description—Zippers (Fasteners, Slide Interlocking), A-A-55634C, Oct. 30, 2019, 32 pages, downloaded from http://assist.dla.mil on Mar. 24, 2020.

* cited by examiner

SLIDE FASTENER SEALING SYSTEMS AND METHODS

REFERENCE TO RELATED APPLICATION

This application claims the benefit of U.S. Provisional Patent Application No. 63/145,087, filed on Feb. 3, 2021 and entitled SLIDE FASTENER SEALING SYSTEMS AND METHODS, the content of which is hereby incorporated by reference in its entirety.

FIELD OF THE INVENTION

This application relates to slide fastener sealing systems and related methods that can be used in applications involving liquids or potentially harmful gases.

BACKGROUND

Zippers and other slide fasteners can be used to fasten components that may be used in applications that may involve liquids and/or potentially harmful gases. As some non-limiting examples, zippers and other slide fasteners may be used in waterproof garments, laboratory suits, boat covers, and other applications as desired. As one non-limiting example, zippers and other slide fasteners can be used to fasten components of a waterproof garment together in a removable fashion, to allow a user to relatively easily put the garment on and take it off. In applications that may involve liquids and/or potentially harmful gases, the slide fastener should ideally not detract from the ability of the article (e.g., the waterproof garment) to resist or minimize passage of fluid and/or gas into or out of the article. While there are some sealing zippers and zipper systems on the market that have been used for this purpose, available options all have disadvantages, and there remains room for improvement. This patent describes improved slide fastener sealing systems and related methods.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a slide fastener sealing system includes a separating slide fastener that includes a first tape and a second tape, where each tape includes a first end, a second end, and fastening elements positioned along the tape. In some embodiments, the first end of the first tape overlaps and is secured to the second end of the first tape, the first end of the second tape overlaps and is secured to the second end of the second tape, and a sealing zone is located between the overlapping ends of the first and second tapes. The separating slide fastener also includes a slider configured to engage and disengage the fastening elements of the first and second tapes, the first tape being separable from the second tape when the fastening elements are disengaged. In some embodiments, the sealing zone includes a passage surrounded on the passage's sides by the first and second tapes. In various embodiments, the slide fastener sealing system includes a sealing member configured to be secured to the slide fastener in a removable fashion such that at least a portion of the sealing member is positioned in the sealing zone to seal the passage. The sealing member includes a sealing body, a connector configured to connect the sealing member to the slide fastener, and a sealing body actuator configured to expand the sealing body.

In some embodiments, the slide fastener includes a first side seal located between the first and second ends of the first tape in the sealing zone, and a second side seal located between the first and second ends of the second tape in the sealing zone. The connector may be configured to connect to the second ends of the first and second tapes. In some aspects, the second end of one of the tapes includes a retaining box, and the connector includes a resilient hook configured to connect to the retaining box in a removable fashion. In various embodiments, the sealing member is configured such that when the connector connects the sealing member to the slide fastener, the sealing body is located adjacent the first and second side seals in the sealing zone. In some cases, the sealing body actuator extends through the sealing body in a sliding fashion. The sealing body actuator may include a thicker portion configured to expand the sealing body when the thicker portion is slid into the sealing body. In various embodiments, the sealing body actuator includes a pull configured to extend beyond the passageway.

In various embodiments, a material of the sealing body has a Shore hardness in the range of and including OO-30 to Shore D-65. In some embodiments, a material of the first and second side seals has a Shore A hardness in the range of and including 50 to 70. In certain embodiments, when the sealing member is positioned in the sealing zone and the fastening elements of the first tape are engaged with the fastening elements of the second tape, the slide fastener sealing system is configured to prevent fluid at a pressure of at least 1 PSI from penetrating through the sealing zone for at least 20 seconds.

According to certain embodiments of the present invention, a slide fastener sealing system includes a separating slide fastener having a first tape and a second tape where each tape includes a first end, a second end, and fastening elements positioned along the tape. In some embodiments, the first end of the first tape overlaps and is secured to the second end of the first tape, the first end of the second tape overlaps and is secured to the second end of the second tape, and a sealing zone is located between the overlapping ends of the first and second tapes. The slide fastener may include a slider configured to engage and disengage the fastening elements of the first and second tapes, the first tape being separable from the second tape when the fastening elements are disengaged. In certain embodiments, the sealing zone includes a passage surrounded on the passage's sides by the first and second tapes. A first side seal may be located between the first and second ends of the first tape in the sealing zone, and a second side seal may be located between the first and second ends of the second tape in the sealing zone. The slide fastener sealing system may also include a sealing member configured to be secured to the slide fastener in a removable fashion such that at least a portion of the sealing member is positioned in the sealing zone to seal the passage. The sealing member includes a sealing body and a connector configured to connect the sealing member to the slide fastener According to certain embodiments of the present invention, a sealing member for a slide fastener sealing system includes a deformable sealing body, a connector attached to the sealing body and having a resilient hook configured to connect the sealing member to a slide fastener, and a sealing body actuator configured to deform and expand the sealing body when actuated. In some embodiments, the sealing body actuator extends through the sealing body in a sliding fashion. In some embodiments, the material of the sealing body has a Shore A hardness in the range of and including 0 to 10.

According to various embodiments of the present invention, a method of sealing a multi-piece article includes fastening together a first piece and a second piece of the multi-piece article with a slide fastener and connecting a sealing member to the slide fastener. The slide fastener includes a first tape associated with the first piece of the article and a second tape associated with the second piece of the article, and each tape includes a first end, a second end, and fastening elements positioned along the tape. In some embodiments, the first end of the first tape overlaps and is secured to the second end of the first tape, the first end of the second tape overlaps and is secured to the second end of the second tape, and a sealing zone is located between the overlapping ends of the first and second tapes. The sealing member includes a sealing body, a connector configured to connect the sealing member to the slide fastener, and a sealing body actuator. In some embodiments, the method includes actuating the sealing body actuator to expand the sealing body and seal the sealing zone.

According to some embodiments of the present invention, a slide fastener sealing system includes a slide fastener having a first and second tape, each tape including a first end, a second end, and fastening elements positioned along the tape. In some embodiments, the first end of the first tape overlaps and is secured to the second end of the first tape, the first end of the second tape overlaps and is secured to the second end of the second tape, and a sealing zone is located between the overlapping ends of the first and second tapes. The slide fastener sealing system may include a sealing member configured to be secured to the slide fastener in a removable fashion such that at least a portion of the sealing member is positioned in the sealing zone. In some embodiments, when the sealing member is positioned in the sealing zone and the fastening elements of the first tape are engaged with the fastening elements of the second tape, the slide fastener sealing system is configured to prevent fluid at a pressure of 1 PSI from penetrating through the sealing zone for 20 seconds.

In various embodiments, when the sealing member is positioned in the sealing zone and the fastening elements of the first tape are engaged with the fastening elements of the second tape, the slide fastener sealing system is configured to prevent fluid at a pressure of 4 PSI from penetrating through the sealing zone for 20 seconds. In some cases, when the sealing member is positioned in the sealing zone and the fastening elements of the first tape are engaged with the fastening elements of the second tape, the slide fastener sealing system is configured to prevent fluid at a pressure of 6.5 PSI from penetrating through the sealing zone for 20 seconds.

In some embodiments, the slide fastener includes a first side seal located between the first and second ends of the first tape in the sealing zone, a second side seal located between the first and second ends of the second tape in the sealing zone, and the first and second side seals each include a material having a Shore A hardness in the range of and including 30 to 90. In various embodiments, the material of the first and second side seals has a Shore A hardness in the range of and including 50 to 70. In certain embodiments, the sealing member further includes a sealing body having a Shore A hardness in the range of and including 0 to 30. In some cases, the material of the sealing body has a Shore A hardness in the range of and including 0 to 10.

In various aspects, the slide fastener includes a first side seal located between the first and second ends of the first tape in the sealing zone, a second side seal located between the first and second ends of the second tape in the sealing zone, and the first and second side seals each include a material having a Shore A hardness in the range of and including 30 to 90. In some cases, the sealing member includes a sealing body, and the sealing body includes a material having a Shore A hardness in the range of and including 0 to 30. In some embodiments, the slide fastener comprises a separating slide fastener.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

DETAILED DESCRIPTION

Several examples of slide fastener sealing systems and related methods are described below. The example illustrated in FIGS. 1-11 will be discussed first.

Structure and Relationship of Parts

Figure 4:
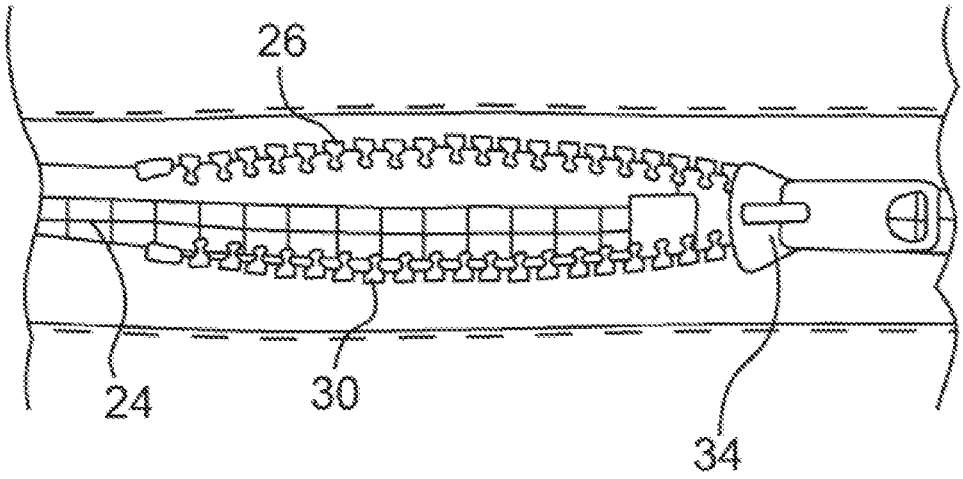
FIG. 4 is a front elevation view of the sealed zipper assembly illustrated in FIG. 1, in a slider closing position.
Figure 5:
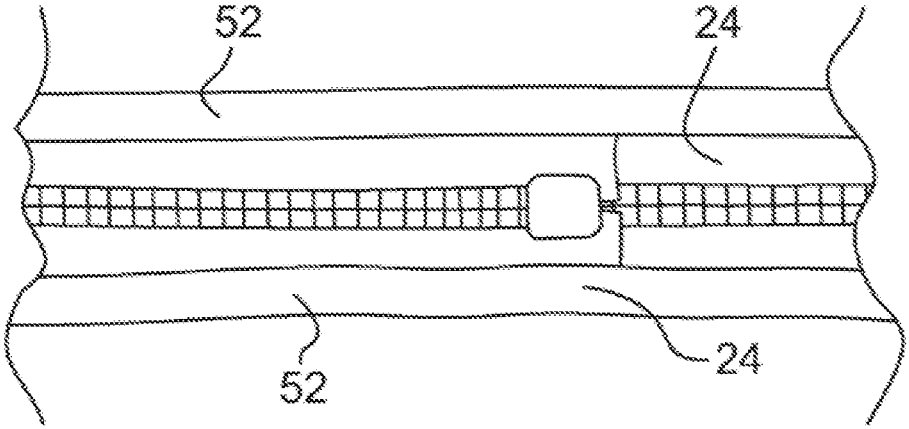
FIG. 5 is a rear elevation view of the sealed zipper assembly illustrated in FIG. 1, in a closed position.
Figure 6:
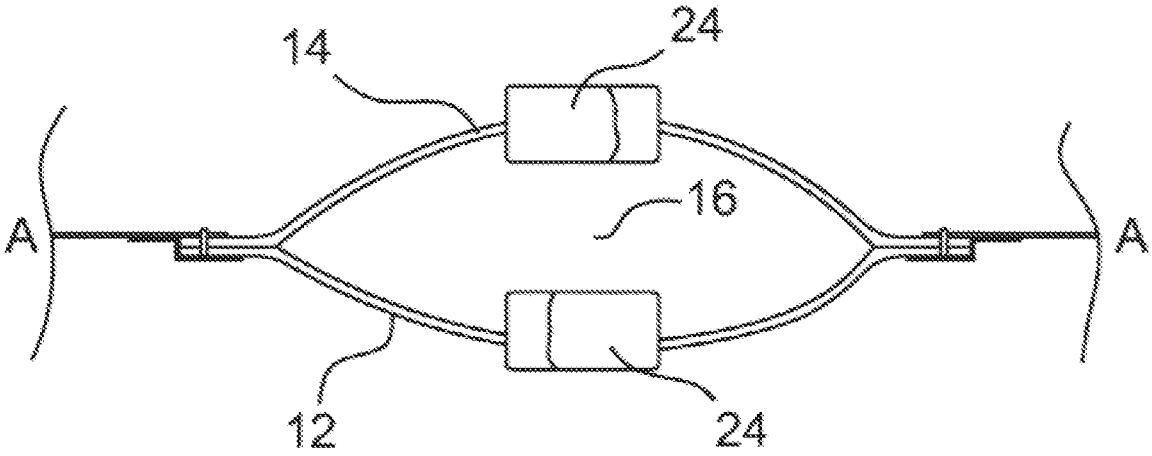
FIG. 6 is a section view of the sealed zipper assembly taken along section lines A-A of FIG. 1.
Figure 9:
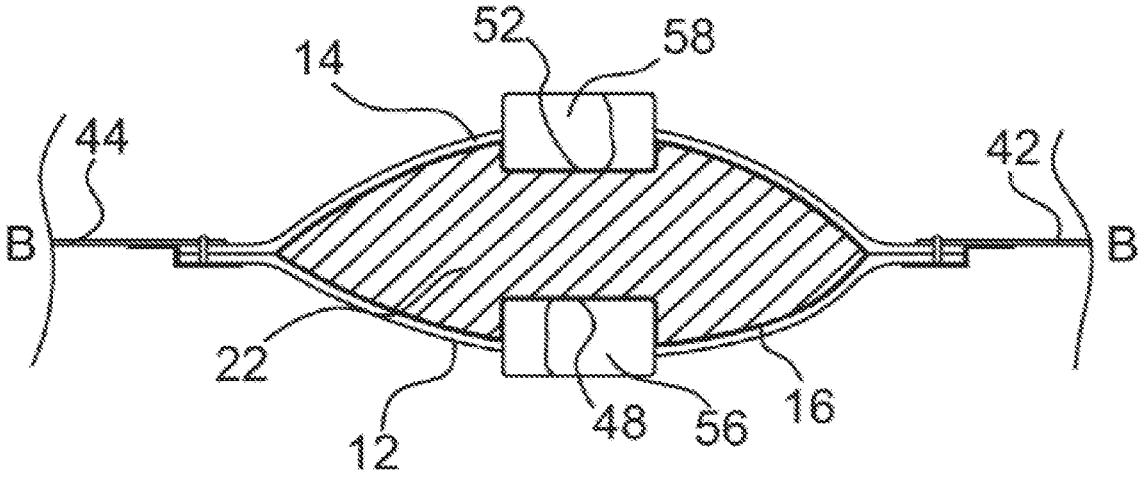
FIG. 9 is a section view of the sealed zipper assembly taken along section lines B-B of FIG. 8.
Figure 10:
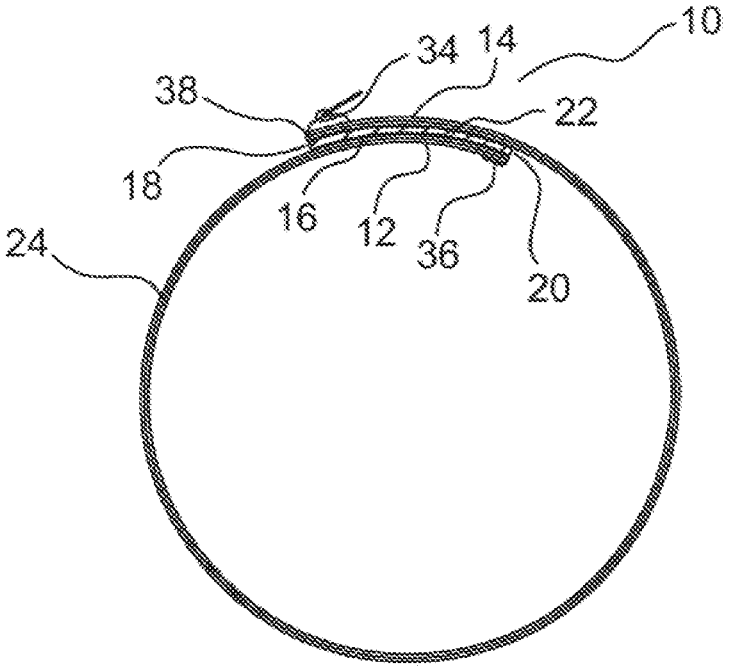
FIG. 10 is a top plan view of the sealed zipper assembly illustrated in FIG. 8.
Figure 11:
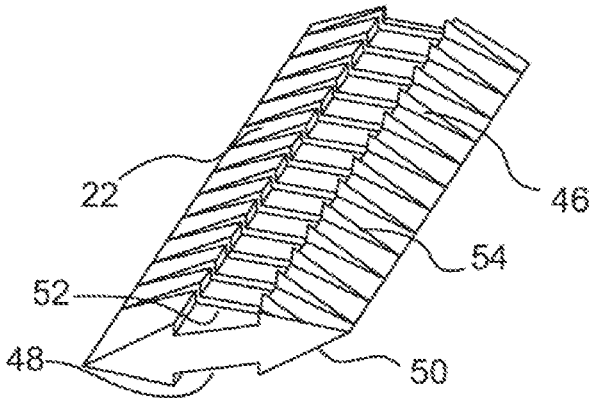
FIG. 11 is a perspective view of the sealing element illustrated in FIG. 9

Referring to FIG. 10, the sealed zipper assembly of FIGS. 1-11 includes a first zipper segment 12 and a second zipper segment 14 in overlapping relation to create a sealing zone 16. Referring to FIG. 6 and FIG. 9, sealing zone 16 can be viewed as forming a tunnel. Referring to FIG. 10, in this regard, sealing zone 16 has an exterior opening 18 and an interior opening 20. Referring to FIG. 9 and FIG. 10, a sealing element 22 is positioned in sealing zone 16 to prevent leakage between first zipper segment 12 and second zipper segment 14. Referring to FIG. 11, sealing element 22 is illustrated. Referring to FIG. 9 and FIG. 10, sealing element 22 is resiliently deformable and is compressed within sealing zone 16 by first zipper segment 12 and second zipper segment 14. Referring to FIG. 10, it will be noted that with this first example, first zipper segment 12 and second zipper segment 14 are part of a single interlocking zipper fastener 24 and create a single sealing zone, previously identified as sealing zone 16. As will hereinafter be illustrated and described with reference to other examples, there can be more than one interlocking zipper fastener and more than one sealing zone.

Figure 7:
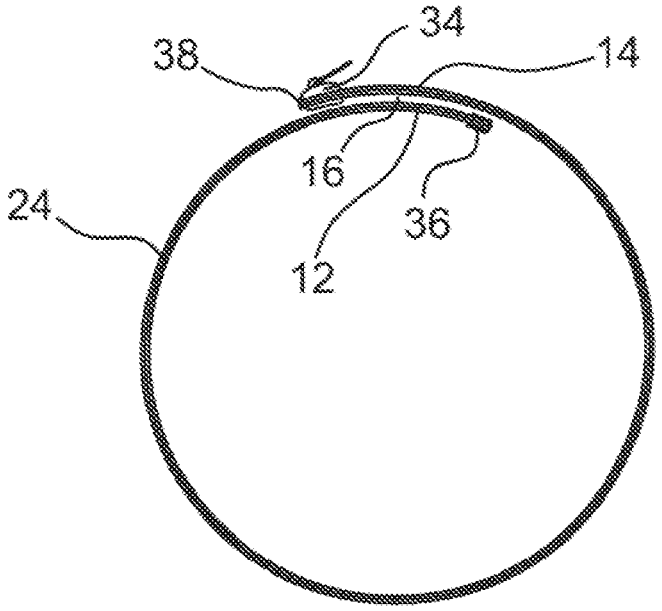
FIG. 7 is a top plan view of the sealed zipper assembly illustrated in FIG. 1.
Figure 8:
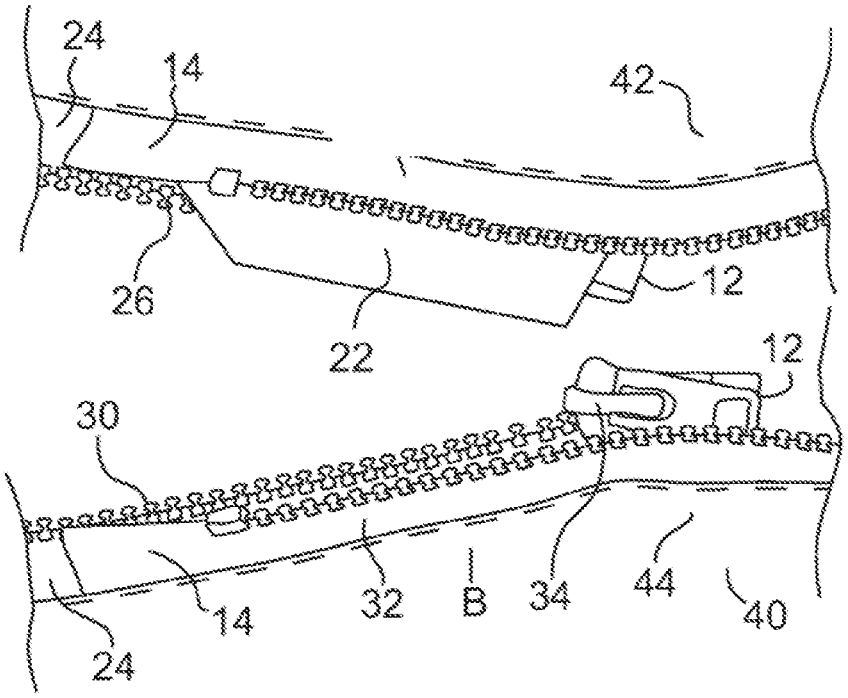
FIG. 8 is a front elevation view of the sealed zipper assembly illustrated in FIG. 1, in an open position with a sealing element.

Referring to FIG. 1 through FIG. 5 and FIG. 8, interlocking zipper fastener 24 has a first series of interlocking teeth 26 supported on a band 28 and a second series of interlocking teeth 30 supported on a band 32. At least one slider 34 is provided. Referring to FIG. 7 and FIG. 10, interlocking zipper fastener 24 has a first end 36 that serves as first zipper segment 12 and a second end 38 that serves as second zipper segment 14 in this embodiment.

Figure 2:
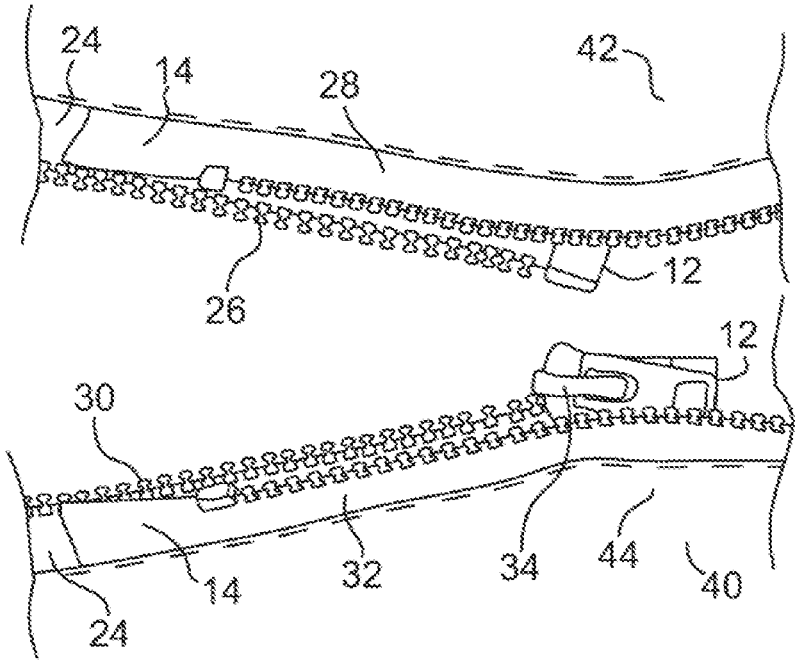
FIG. 2 is a front elevation view of the sealed zipper assembly illustrated in FIG. 1, in an open position.

Referring to FIG. 2, a garment body 40 made with waterproof fabric consists of a first or upper discrete body component 42 and a second or lower discrete body component 44. Interlocking zipper fastener 24 is in a circular configuration that enables first discrete body component 42 to be separated from second discrete body component 44. Referring to FIG. 2, band 28 supporting first series of interlocking teeth 26 constituting a first half of interlocking zipper fastener 24 is secured to first discrete body component 42 in a generally circular configuration to form a first half of first zipper segment 12 and a first half of second zipper segment 14 in overlapping relation. Similarly, band 32 supporting second series of interlocking teeth 30 constituting a second half of interlocking zipper fastener 24 is secured to second discrete body 44 component in a generally circular configuration to form a second half of the first zipper segment 12 and a second half of the second zipper segment 14 in overlapping relation.

Figure 1:
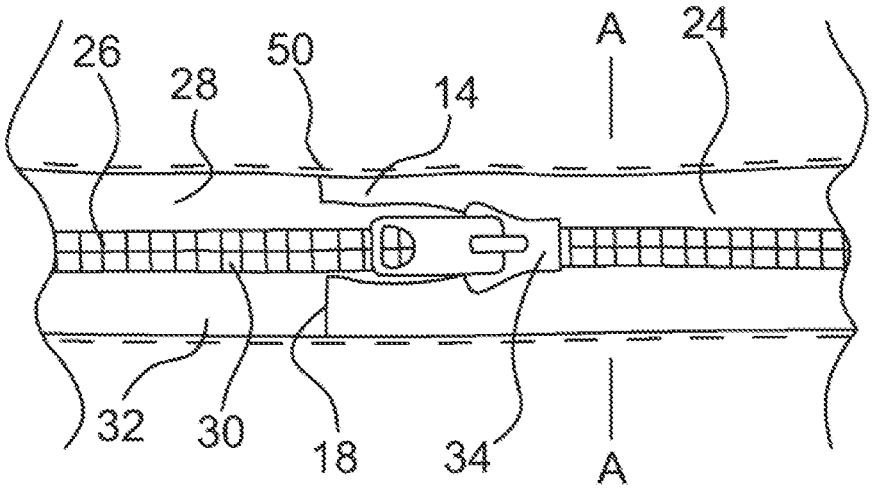
FIG. 1 is a front elevation view of an example of a sealed zipper assembly in a closed position.
Figure 3:
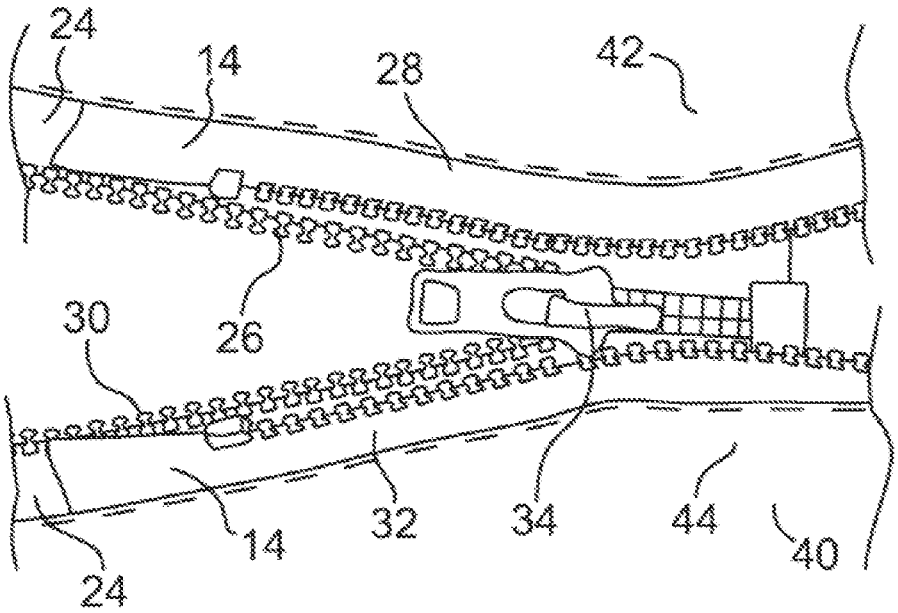
FIG. 3 is a front elevation view of the sealed zipper assembly illustrated in FIG. 1, in a slider starting position.

Referring to FIG. 3, slider 34 is used to slide along interlocking zipper fastener 24 in a first direction to bring first series of interlocking teeth 26 and second series of interlocking teeth 30 into engagement as illustrated in FIG. 1. Referring to FIG. 4, slider 34 slides along interlocking zipper fastener 24 in a second direction to disengage first series of interlocking teeth 26 and second series of interlocking teeth 30 to disengage interlocking zipper fastener 24, as illustrated in FIG. 2. Referring to FIG. 6, FIG. 7, FIG. 9 and FIG. 10, as slider 34 interlocks first series of interlocking teeth 26 and second series of interlocking teeth 30, it completes first zipper segment 12 and second zipper segment 14, the overlapping of which creates sealing zone 16. Sealing zone 16 is then ready to receive sealing element 22. Referring to FIG. 11, sealing element 22 has ridges 46 that assist in sealing. Sealing element 22 also has a first channel 48 on a first face 50 and a second channel 52 on a second face 54. Referring to FIG. 9, First channel 48 receives interlocked teeth 56 of first zipper segment 12 and second channel 52 receives interlocked teeth 58 of second zipper segment 14.

Operation

Referring to FIG. 2, band 28 supporting first series of interlocking teeth 26 constituting a first half of interlocking zipper fastener 24 is secured to first discrete body component 42 in a generally circular configuration to form a first half of first zipper segment 12 and a first half of second zipper segment 14 in overlapping relation. Band 32 supporting second series of interlocking teeth 30 constituting a second half of interlocking zipper fastener 24 is secured to second discrete body 44 component in a generally circular configuration to form a second half of the first zipper segment 12 and a second half of the second zipper segment 14 in overlapping relation. Referring to FIG. 3, slider 34 slides along interlocking zipper fastener 24 in a first direction to bring first series of interlocking teeth 26 and second series of interlocking teeth 30 into engagement as illustrated in FIG. 1. Referring to FIG. 6 and FIG. 7, as slider 34 interlocks first series of interlocking teeth 26 and second series of interlocking teeth 30, it completes first zipper segment 12 and second zipper segment 14 the overlapping of which creates sealing zone 16. Referring to FIG. 9 and FIG. 10, sealing element 22 is compressed within sealing zone 16 by first zipper segment 12 and second zipper segment 14.

Variations

There will hereinafter be described several variations that may be made to the first example described above.

Figure 12:
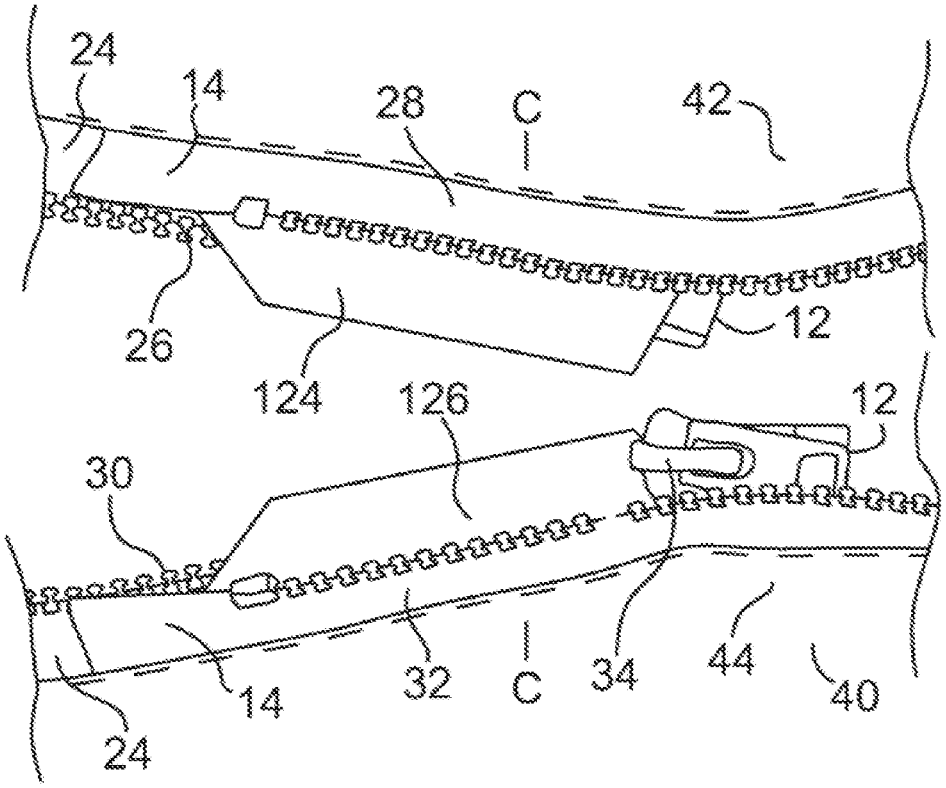
FIG. 12 is a front elevation view of another example of a sealed zipper assembly in an open position.
Figure 13:
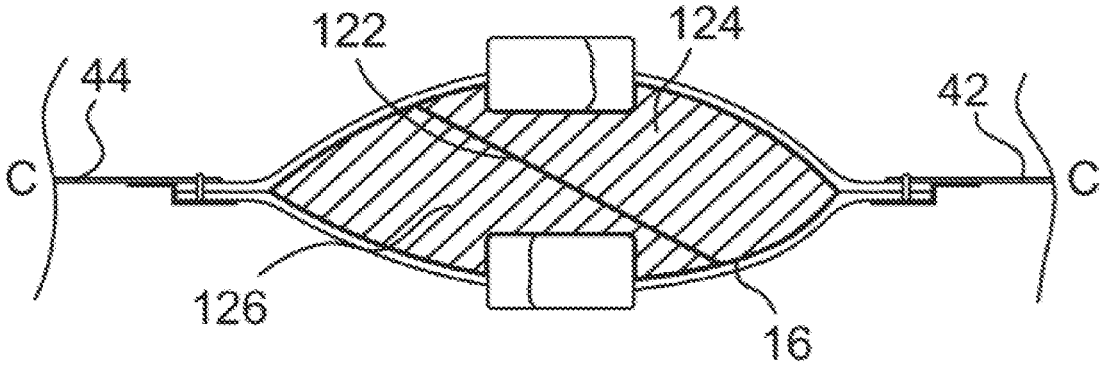
FIG. 13 is a section view of the sealed zipper assembly of FIG. 12 taken along section lines C-C of FIG. 12.
Figure 14:
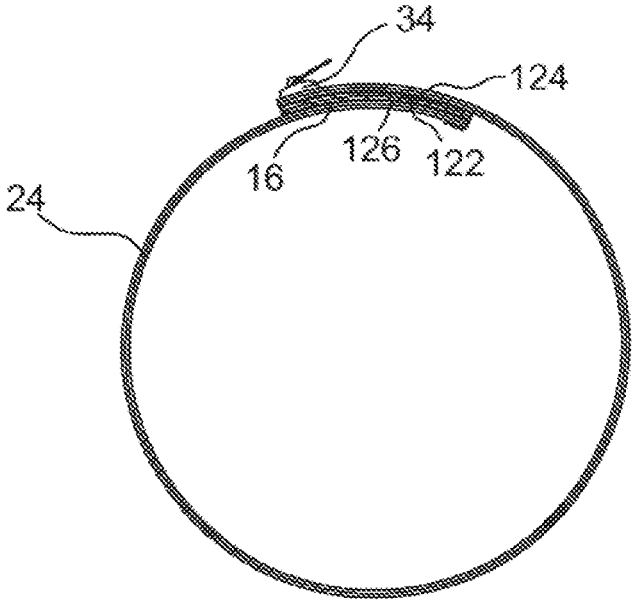
FIG. 14 is a top plan view of the sealed zipper assembly illustrated in FIG. 12.
Figure 15:
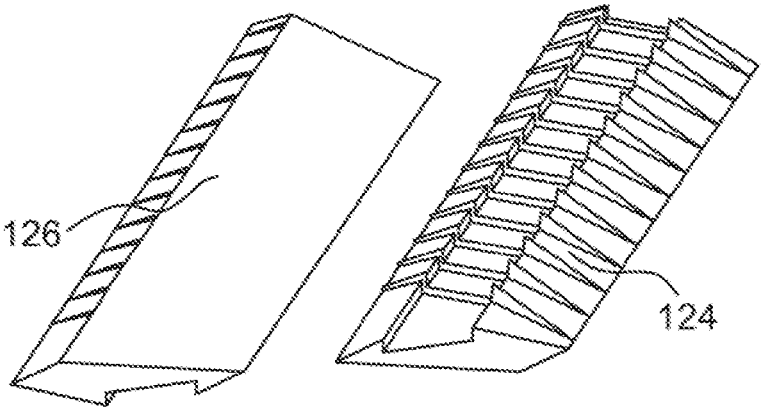
FIG. 15 is an exploded perspective view of the sealing element of FIG. 13.

The first example included a single sealing element 22. Referring to FIG. 15, there is illustrated an alternative sealing element 122 that has a first seal component 124 and a second seal component 126. Referring to FIG. 12, first seal component 124 is wedged into and held by friction or otherwise secured to first discrete body component 42. Second seal component 126 is wedged into and held by friction or otherwise secured to second discrete body component 44. Referring to FIG. 13 and FIG. 14, when interlocking zipper fastener 24 is closed, first seal component 124 and second seal component 126 are forced together to form sealing element 122 which fills sealing zone 16.

Figure 16:
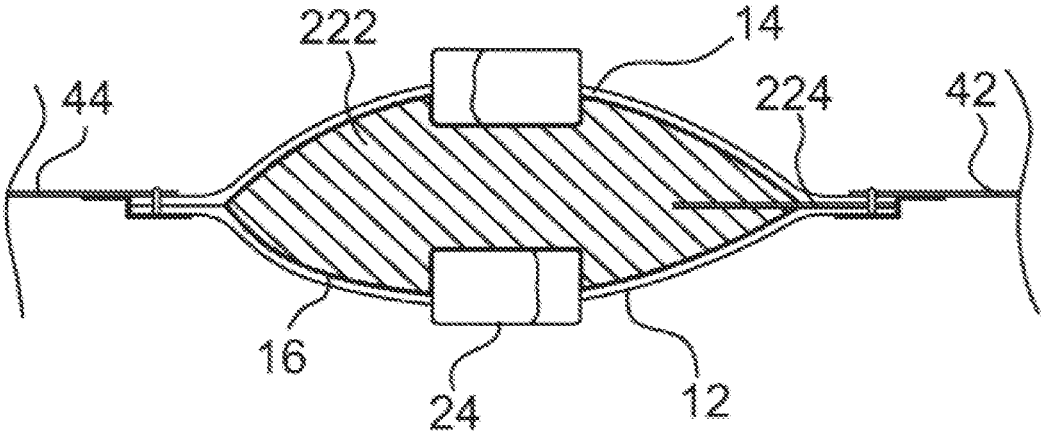
FIG. 16 is a section view of another example of a sealed zipper assembly.
Figure 17:
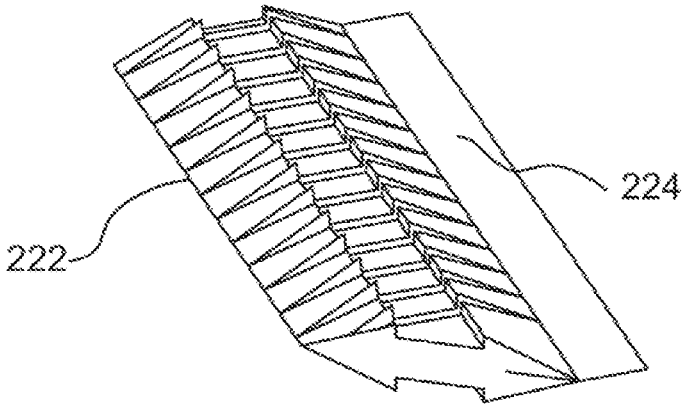
FIG. 17 is a perspective view of the sealing element illustrated in FIG. 16.

In the first example discussed above, sealing element 22 was held in place by friction and was removable. Referring to FIG. 16 and FIG. 17, alternative sealing element 222 has a fabric strip 224 moulded into the elastomeric foam. Fabric strip 224 is used to secure alternative sealing element 222 to first discrete body component 42. This is done by stitching through fabric strip 224. Fabric strip 224 serves to anchor alternative sealing element 222 to first discrete body component 42 in a desired position where sealing zone 16 is formed by the overlapping of first zipper segment 12 and second zipper segment 14 of interlocking zipper fastener 24. It will be appreciated that there are other ways to secure alternative sealing element within sealing zone 16.

Figure 18:
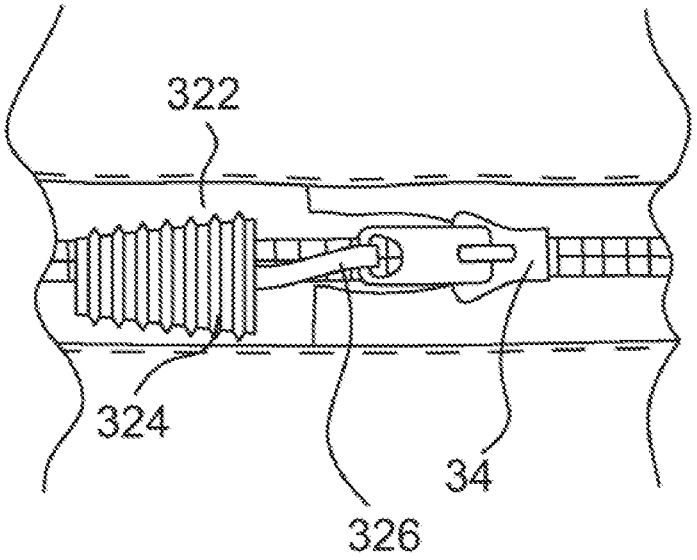
FIG. 18 is a front elevation view of another example of a sealed zipper assembly in a closed position, prior to sealing.
Figure 19:
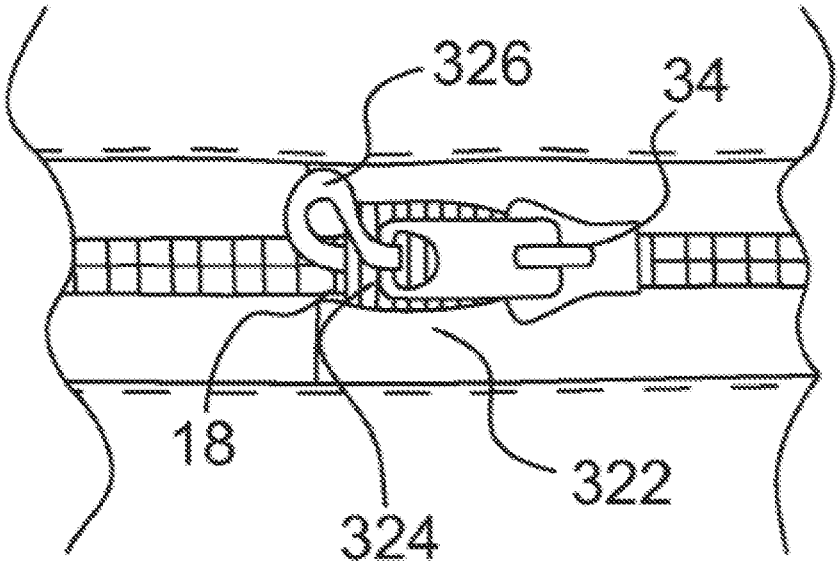
FIG. 19 is a front elevation view of the sealed zipper assembly of FIG. 18, shown with the sealing element inserted into the sealing zone.

In the first example discussed above, sealing element 22 was elastomeric foam. Referring to FIG. 18 and FIG. 19 an alternative sealing element 322 is illustrated. Referring to FIG. 18, sealing element 322 is a plug 324 that is suspended by a tether 326 from slider 34 when not in use. Referring to FIG. 19, plug 324 is intended to be inserted into exterior opening 18 of sealing zone 16 to seal sealing zone 16. It is preferred that plug 324 have a surface profile, such as ribs or ridges, to enhance both the sealing capacity and the holding capacity of plug 324. It will be appreciated that there are other raised surface profiles that would similarly serve this purpose.

Figure 22:
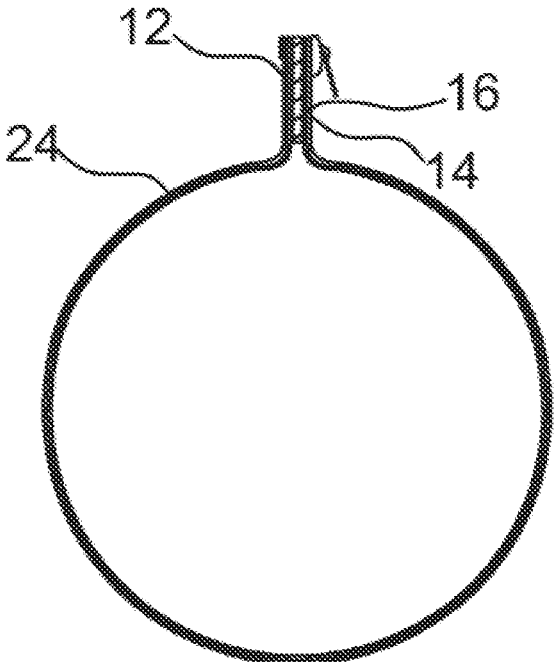
FIG. 22 is a top plan view of another example of a sealed zipper assembly.

In the first example discussed above, first zipper segment 12 and second zipper segment 14 are positioned substantially parallel to interlocking zipper fastener 24. Referring to FIG. 22, first zipper segment 12 and second zipper segment 14 which form sealing zone 16, can be configured so that they project outwardly or radially from interlocking zipper fastener 24.

Figure 23:
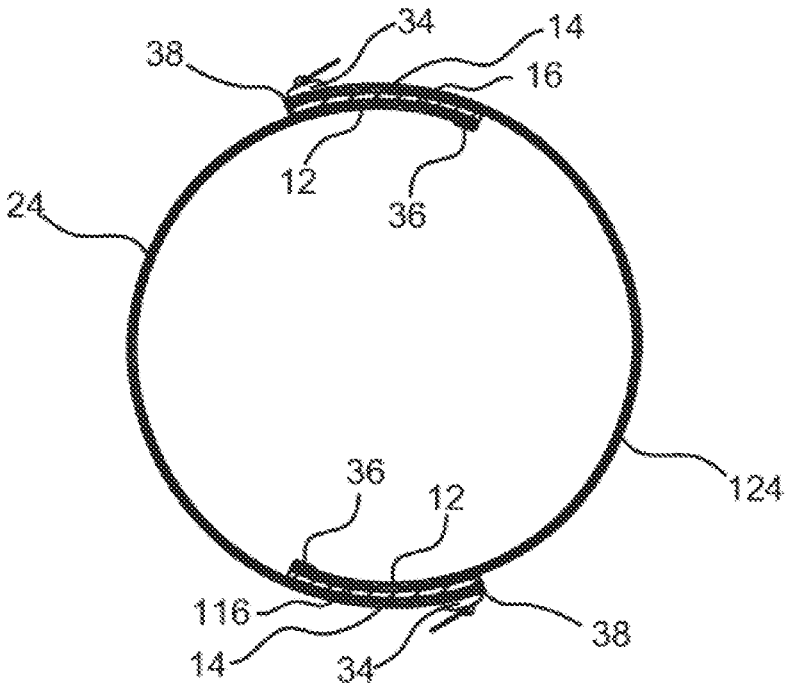
FIG. 23 is a top plan view of another example of a sealed zipper assembly.

In the first example discussed above, there was only one interlocking zipper fastener 24 and only one sealing zone 16. Referring to FIG. 23, there is shown a configuration that has more than one interlocking zipper fastener 24 and more than one sealing zone 16. With this configuration, first end 36 of one interlocking zipper fastener 24 serves as first zipper segment 12 and second end 38 of another interlocking zipper fastener 124 serves as second zipper segment 14 to create a first sealing zone 16. In addition, first end 36 of interlocking zipper fastener 124 serves as first zipper segment 12 and second end 38 of interlocking zipper fastener 24 serves as second zipper segment 14 to create a second sealing zone 116. It will be appreciated that although two interlocking zipper fasteners 24 and 124 have been illustrated in a circular configuration more than two interlocking zipper fastener could also be arranged in a circular configuration in a like manner.

Figure 24:
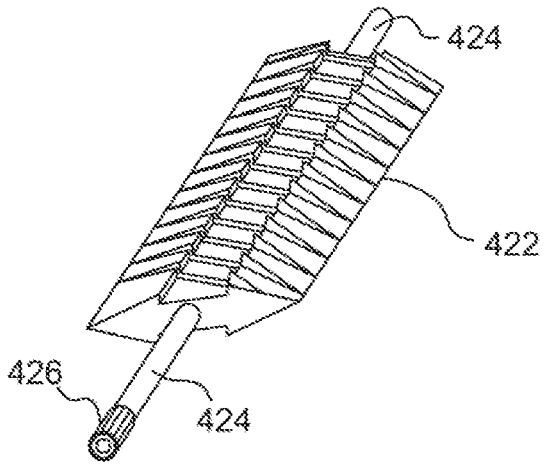
FIG. 24 is a perspective view of an example of a sealing element having an air transfer tube.

It is not unusual for a garment intended for use in water, such as garment body 40 to have air transfer valves, to provide for air movement. Referring to FIG. 24, alternative sealing element 422 is shown with an air transfer tube 424 extending through the body of alternative sealing element 422. Air transfer tube 424 allows for movement of air in and out of garment body 40. When garment body 40 is to be submerged in water or another liquid, a closure valve 426 can be used to close air transfer tube 424.

Figure 25:
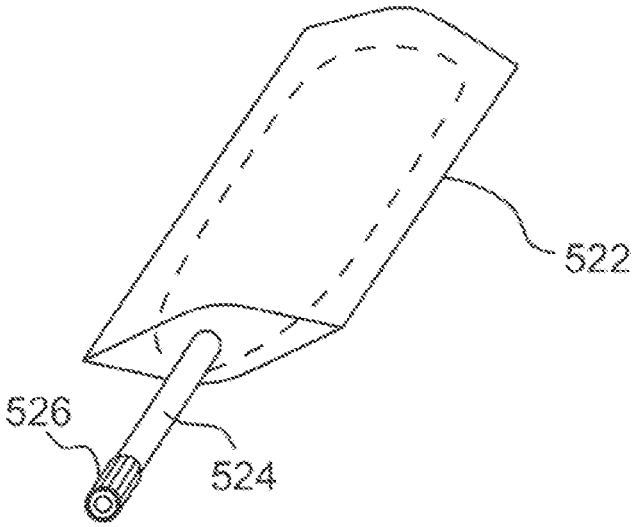
FIG. 25 is a perspective view of an example of an inflatable sealing element.

In the first example discussed above, sealing element 22 was compressed. Referring to FIG. 25, a bladder like alternative sealing element 522 is shown which is expandable like a balloon. Alternative sealing element 522 has a tube 524 into which a user may blow to inflate alternative sealing element 522 and a closure valve 526 that is to maintain air pressure within alternative sealing element 522. When expanded, alternative sealing element 522 expands to occupy sealing zone 16.

Figure 26:
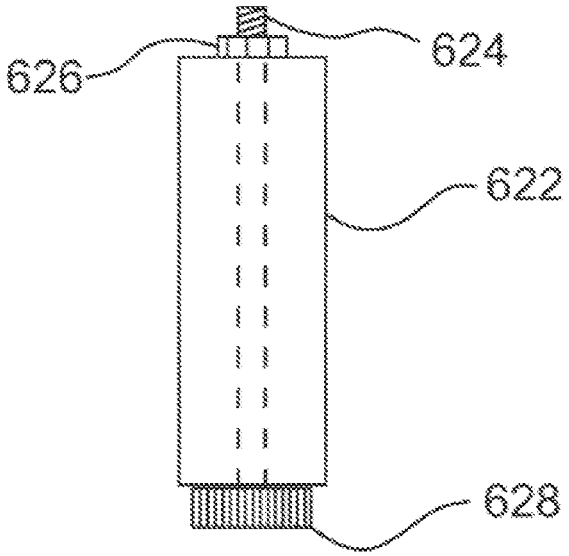
FIG. 26 is a front elevation view of an example of a sealing element that is compressible in a lengthwise direction.

Another alternative sealing element is positioned between two clamping elements with at least one of the clamping elements being movable toward and away from another of the clamping elements. As the clamping elements are moving closer together, the sealing element is forced outwardly to seal the sealing zone. Referring to FIG. 26, one such clamping configuration is illustrated. Alternative sealing element 622 has a bolt 624 that runs through it lengthwise. There is a nut 626 on one end of the bolt 624 and a twist knob 628 on the other end of bolt 624. Nut 626 serves as one clamping element and twist knob 626 serves as another clamping element. Turning twist knob 628 causes axial movement that compresses alternative sealing element 622 between twist knob 628 and nut 626. When compressed, alternative sealing element 622 expands outwardly increasing the circumference of alternative sealing element 622 until alternative sealing element 622 seals the sealing zone.

Cautionary Warnings

It will be appreciated that not all zippers can function in a liquid environment. In order to avoid leakage, one may wish to use a waterproof zipper. It will also be appreciated that there are a number of different styles of waterproof zippers.

In order for the sealing elements described above to be effective, one may wish to take extra precautions to address potential leakage points along stitches and seams.

Referring to FIG. 1, stitches 50 are used to secure interlocking zipper fastener 24 in place. Referring to FIG. 5, waterproof tape 52 is heat sealed or secured by adhesive to reverse side of stitches 50 to prevent liquids weeping through stitches 50.

Figure 20:
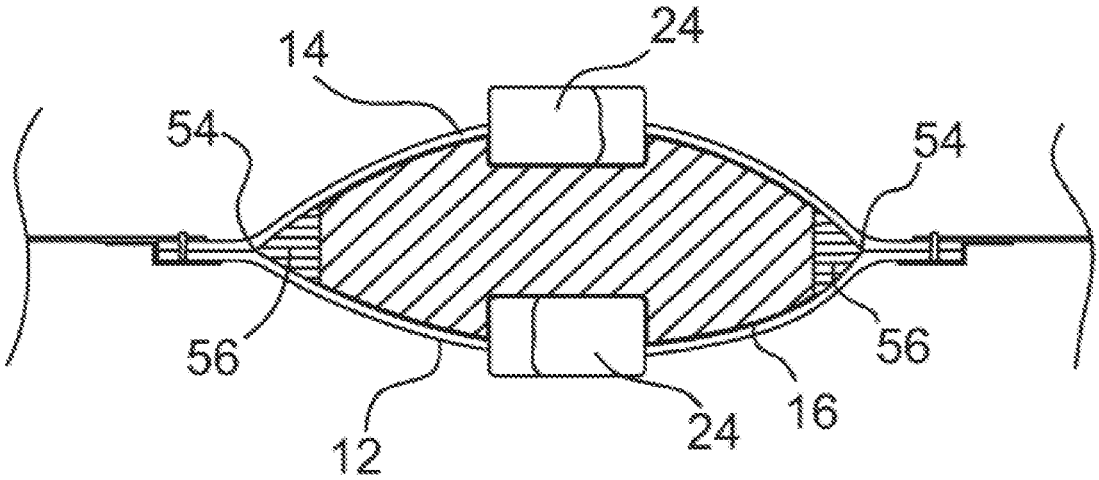
FIG. 20 is a section view of another example of a sealed zipper assembly.
Figure 21:
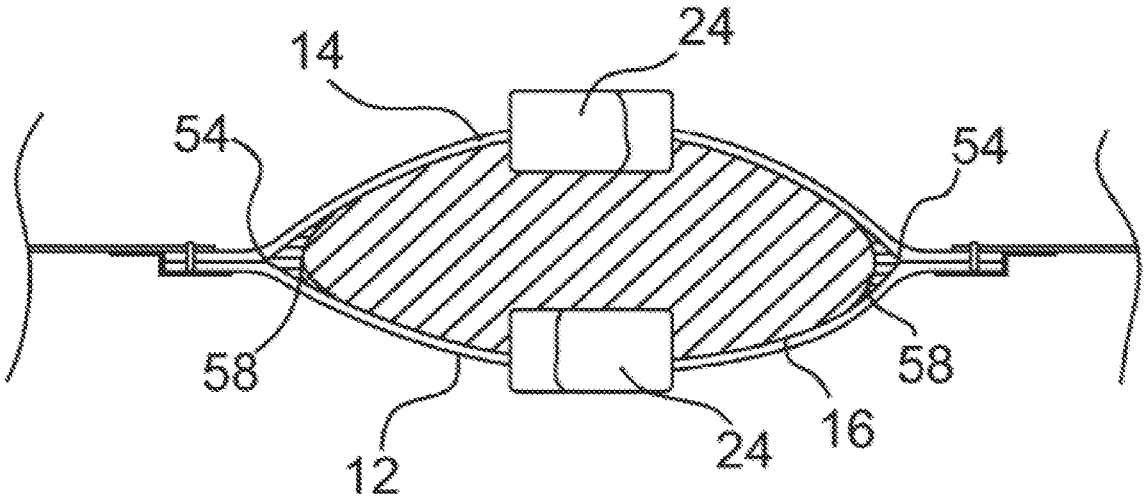
FIG. 21 is a section view of another example of a sealed zipper assembly.

Referring to FIG. 20 and FIG. 21, sealing zone 16 has edge seams 54 that are subject to leakage. Referring to FIG. 20, leakage can be addressed by sealing edge seams 54 with pliable edge moulding 56. Referring to FIG. 21, leakage can also be addressed by sealing edge seams 54 by using a bead 58 of polymer caulking compound.

Improved Slide Fastener Sealing System

FIGS. 27 to 41 show another example of a slide fastener sealing system 1000, featuring improvements, modifications, and alternatives to the slide fastener sealing systems described above. The system 1000 shown in FIG. 27 includes a slide fastener 1002 and a sealing member 1004. The slide fastener sealing system 1000 may be incorporated into multi-piece waterproof garments or other multi-piece sealed systems to allow the pieces of those systems to be fastened together in a removable fashion while still providing for sealing of those systems against fluid leakage through the slide fastener sealing system.

Slide Fastener

Figure 27:
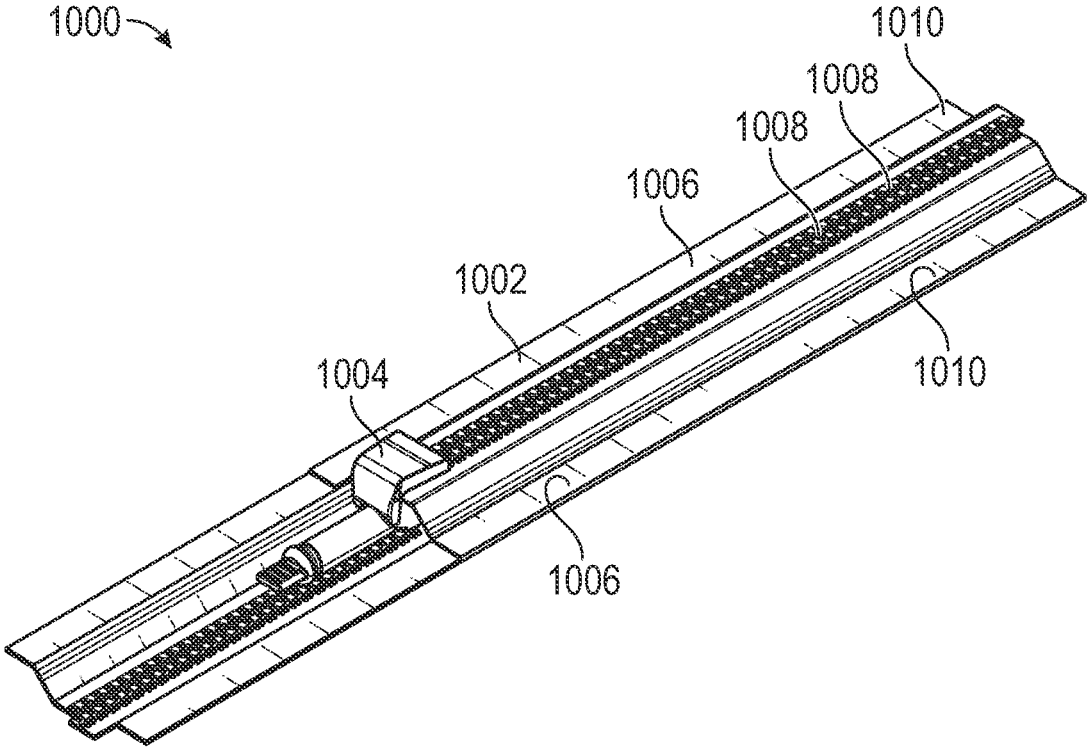
FIG. 27 shows another example of a slide fastening sealing system.
Figure 28:
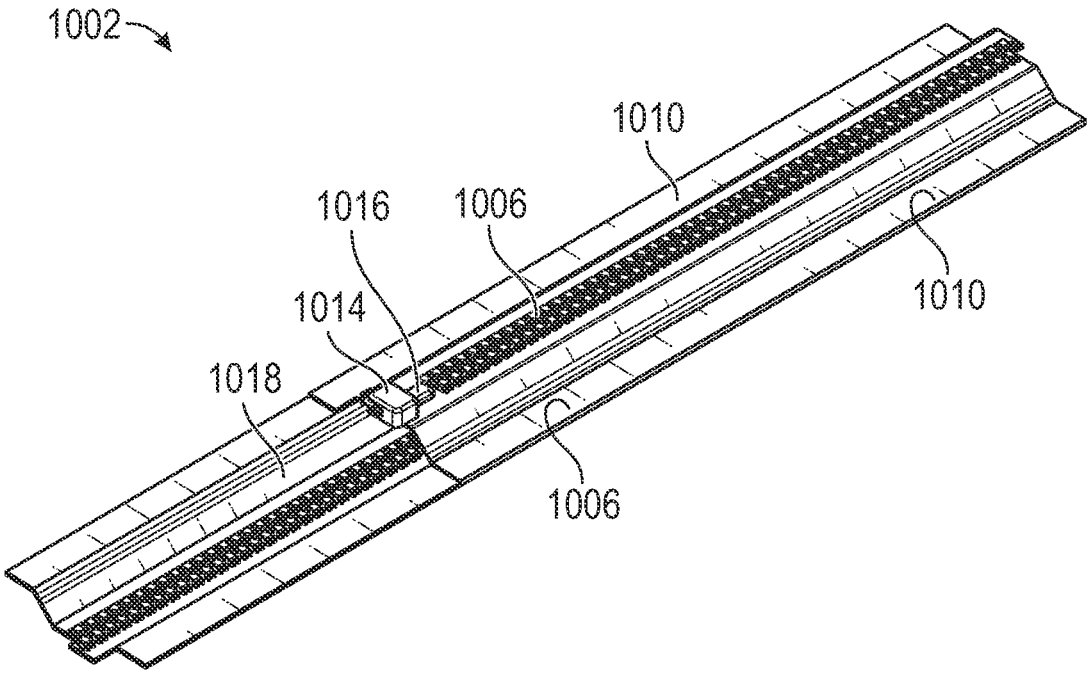
FIGS. 28 and 29 show a slide fastener of the slide fastening sealing system of FIG. 27, with FIG. 29 showing a cross-sectional transverse view.
Figure 29:
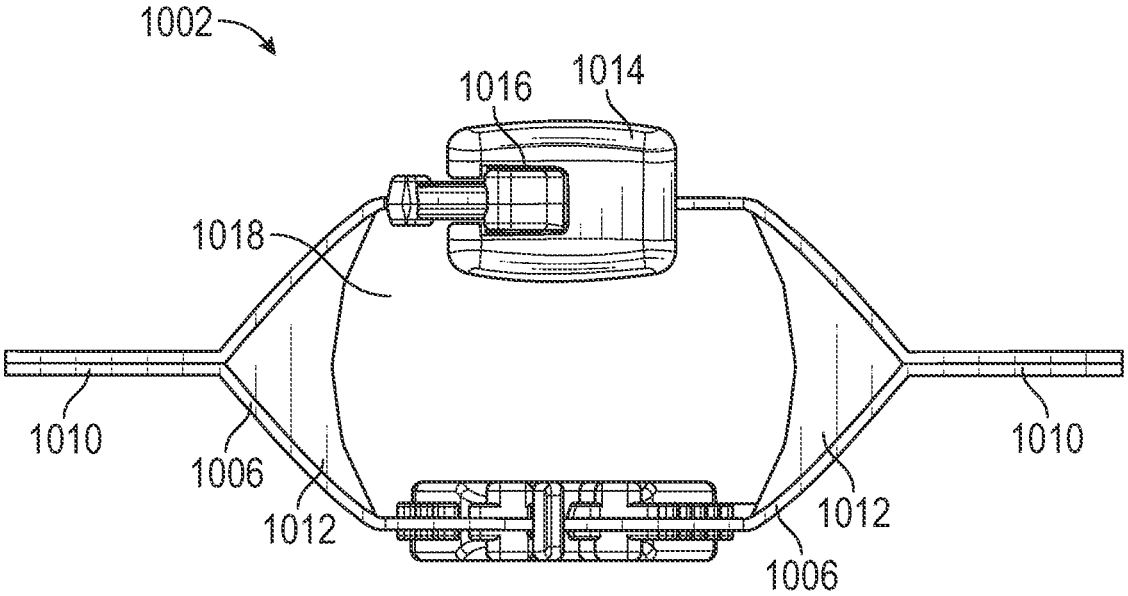
Figure 30:
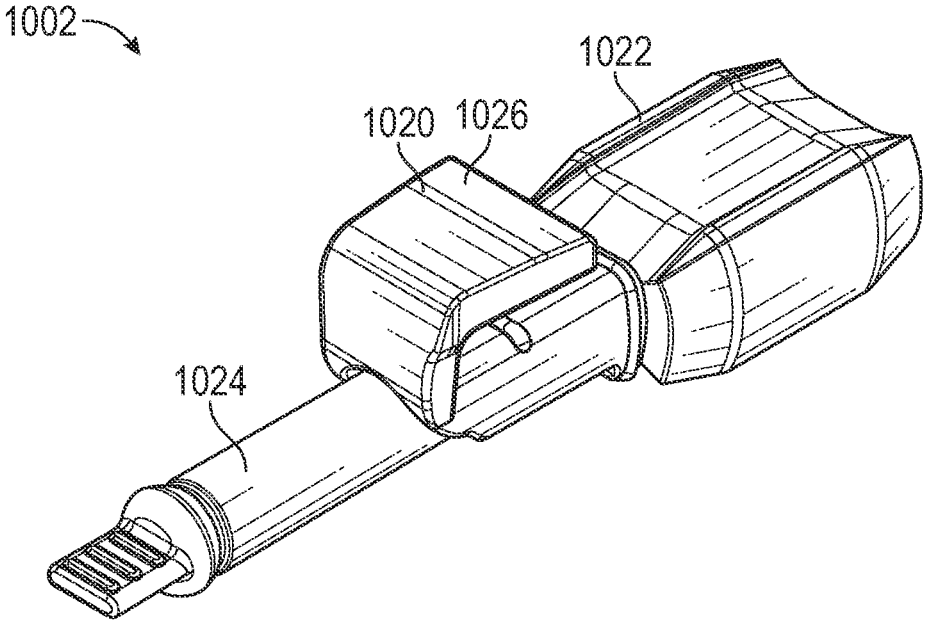
FIGS. 30-33 show a sealing member of the slide fastening system of FIG. 27, with FIG. 33 showing a cross-sectional longitudinal view.
Figure 31:
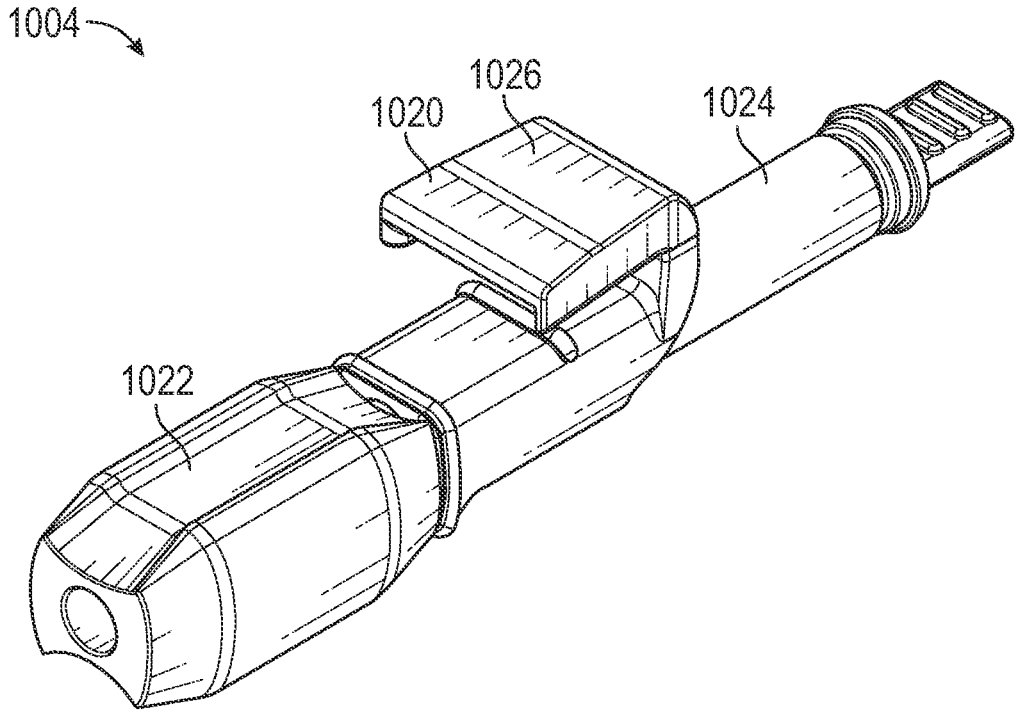
Figure 32:
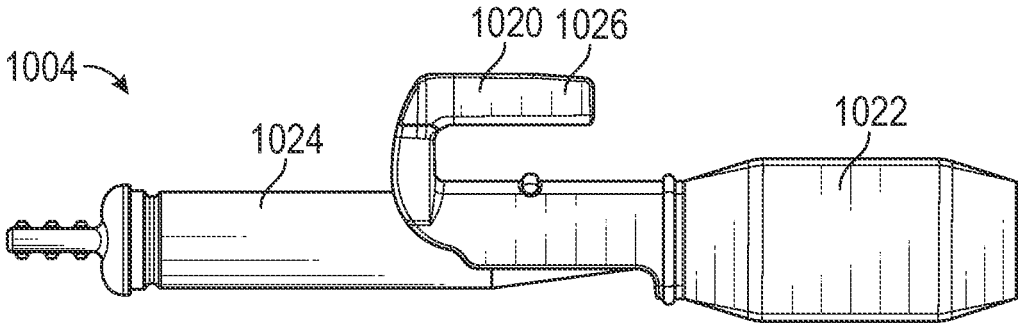
Figure 33:
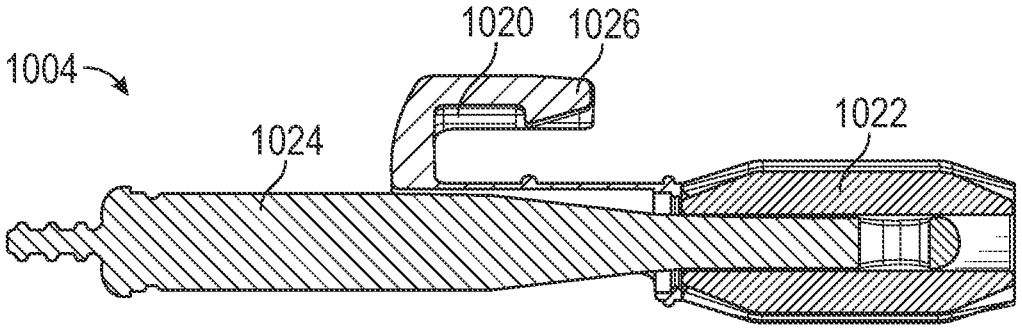

FIGS. 28 and 29 show the slide fastener 1002 of FIG. 27 in more detail, with FIG. 29 showing a cross-section of the slide fastener. The slide fastener 1002 includes two tapes 1006, with each tape having a series of fastening elements 1008 positioned along the tape. Although not shown in FIGS. 28 and 29, the slide fastener 1002 may include a slider (similar to, for example, the slider 34 shown in FIG. 1), which is configured to engage and disengage the fastening elements 1008 of the two tapes 1006 when slid along the slide fastener 1002.

As shown in FIG. 28, one end of the two tapes 1006 overlaps the other end of the two tapes 1006 (only the overlapping and adjacent length of the slide fastener is shown in these Figures). The slide fastener 1002 of FIGS. 28 and 29 may be formed in a loop, similar to the loop shown in FIG. 7. Although FIG. 7 shows a slide fastener formed in a circular loop, other looped shapes and configurations are also possible. As shown in FIGS. 28 and 29, the overlapping ends of each tape 1006 are secured together along their edges 1010. This may be done by heat sealing the edges of the ends of the tape together or in other manners. As shown in FIG. 29, the slide fastener 1002 includes side seals 1012 (discussed later below) in the interior where the overlapping ends of the tapes 1006 are joined together.

The slide fastener shown in this example is a separating slide fastener, in which the two tapes 1006 may be completely detached from one another and reattached in normal use. As shown in FIGS. 28 and 29, the separating slide fastener includes a retaining box 1014 at the end of the series of fastening elements 1008 of one of the tapes 1006, and an insert pin 1016 at the end of the series of fastening elements 1008 of the other tape 1006. The insert pin 1016 may be inserted into retaining box 1014 and the slider slid along the fastening elements 1008 to fasten the two tapes 1006 together. The slider may be slid in an opposite direction and the insert pin 1016 removed from the retaining box 1014 to separate the two tapes 1006 from one another.

As shown in FIG. 29, with the slide fastener 1002 looped with one end of the tapes 1006 overlapping the other end and the edges 1010 of the tapes 1006 secured together, a passage 1018 is formed between the overlapping ends. When the slide fastener 1002 is incorporated into a waterproof garment or other sealed system, the passage 1018 is a place in which water, another liquid, or a gas could penetrate into or out of the system via open ends of the passage 1018 where the tapes 1006 are no longer overlapping. As discussed further below, the passage 1018 defines a sealing zone for receiving sealing member 1004 in order to resist fluid penetration through the passage 1018.

Sealing Member

FIGS. 30-37 show an example of a sealing member 1004 that may be inserted into the passage 1018 of slide fastener 1002 to resist fluid penetration through the passage 1018. In this particular example, the sealing member 1004 includes three components: a connector 1020, a sealing body 1022, and a sealing body actuator 1024.

Figure 34:
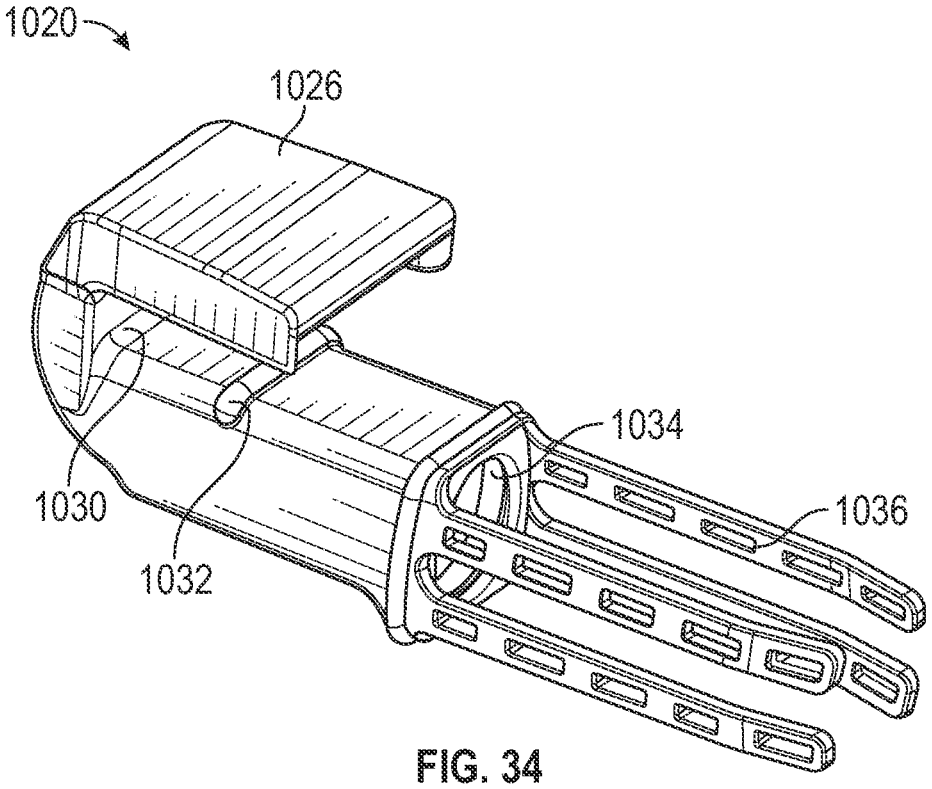
FIGS. 34-35 show a connector component of the sealing member of FIGS. 30-33, with FIG. 35 showing a cross-sectional longitudinal view.
Figure 35:
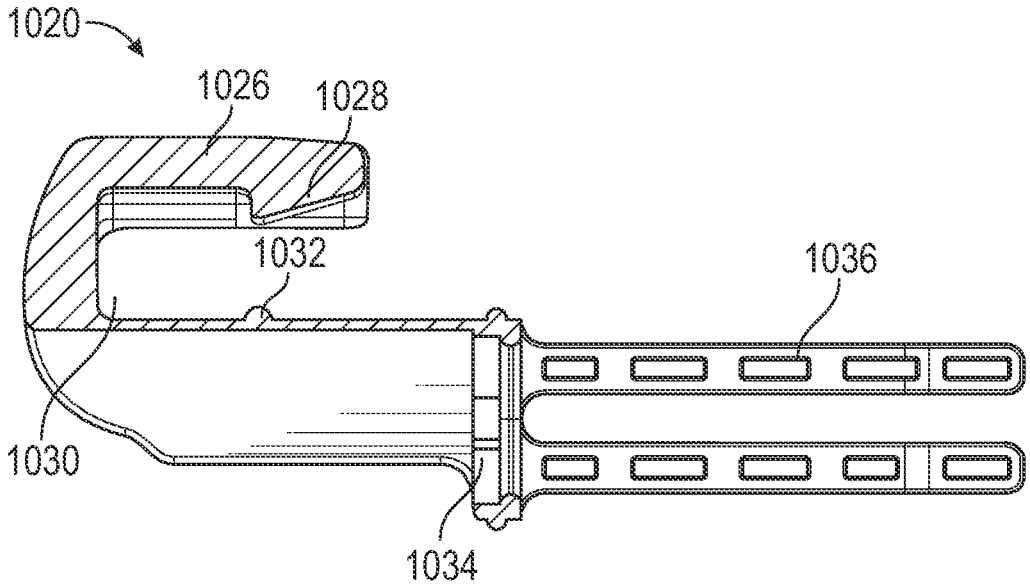
Figure 36:
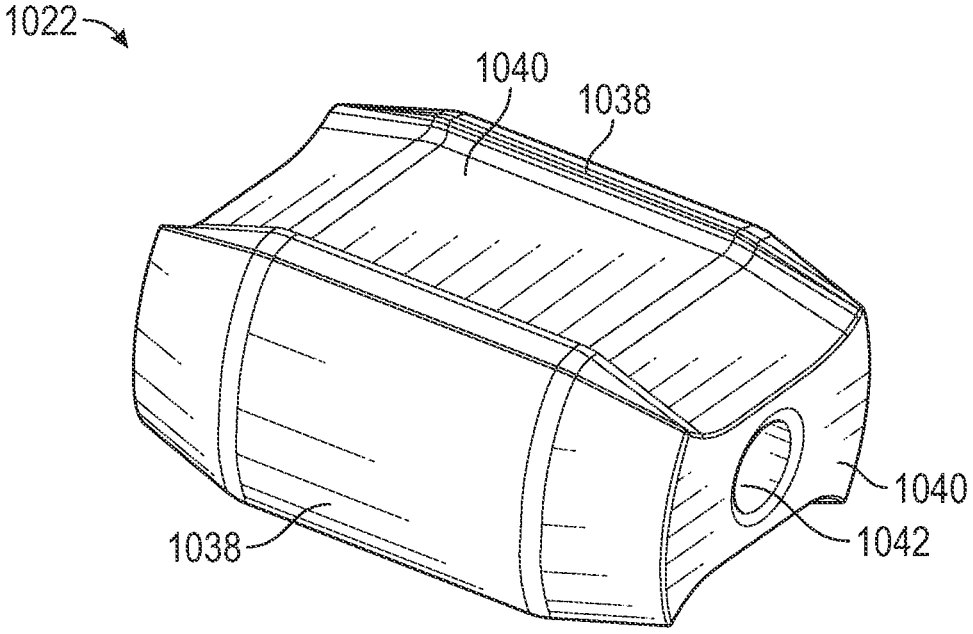
FIG. 36 shows a sealing body component of the sealing member of FIGS. 30-33.

The connector component 1020 is shown disassociated from the rest of the sealing member assembly 1004 in FIGS. 34 and 35. The connector 1020 is configured to connect the sealing member 1004 to the slide fastener 1002. In the particular example shown in FIGS. 34-35, the connector 1020 includes a resilient hook 1026 that hooks around an end of the tapes 1005 of the slide fastener 1002. As shown in FIG. 35, the resilient hook 1026 includes a ramped surface 1028, a recess 1030, and a protrusion 1032 that engage and receive the retaining box 1014 and insert pin 1016 of the slide fastener 1002 to secure the sealing member 1004 in place on an end of the slide fattener tapes 1006. The connector 1020 also includes an aperture 1034 for receiving sealing body actuator 1024 in a sliding fashion, as discussed in further detail below.

The connector 1020 shown in FIGS. 34 and 35 includes arms 1036 that connect and anchor the connector 1020 to the sealing body 1022, which may be molded onto the connector 1020 during manufacture. The sealing body 1022 may be formed from a soft, deformable material. The sealing body 1022 may have a base shape in which the sealing body 1022 is not deformed. As discussed in greater detail below, the sealing body 1022 may be selectively deformed and expanded from the base shape using the sealing body actuator 1024. The sealing body 1022 is shown disassociated from the rest of sealing member assembly 1004 in FIG. 36. The sealing body 1022 has outer sidewalls 1038 that are shaped and otherwise configured to conform to the shape of side seals 1012 of the slide fastener 1002 (see, for example, FIGS. 40-41 discussed further below). The sealing body includes grooved top and bottom surfaces 1040 configured to receive and conform to the fastening elements 1008 of the slide fastener 1002, and also to provide clearance through which the slider can move. As with the connector 1020, the sealing body 1022 includes an aperture 1042 for receiving sealing body actuator 1024 in a sliding fashion.

Figure 37:
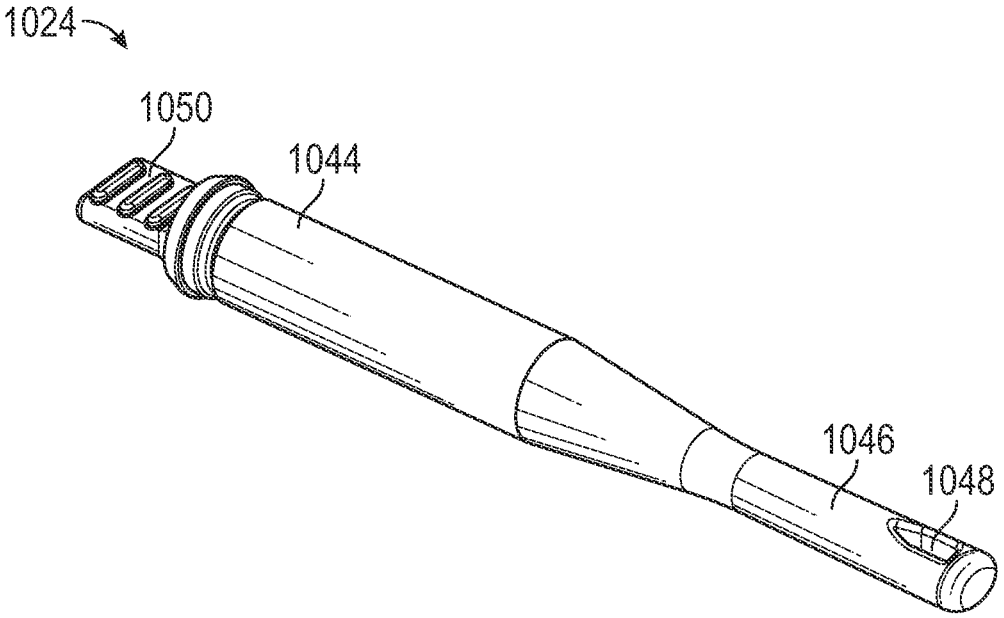
FIG. 37 shows a sealing body actuator of the sealing member of FIGS. 30-33.
Figure 38:
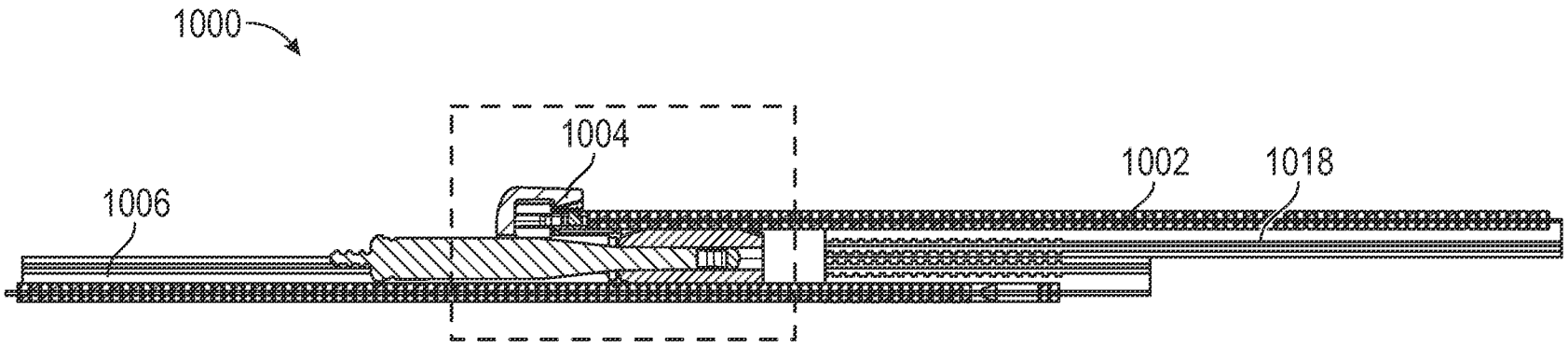
FIGS. 38-41 show additional views of the slide fastening sealing system of FIG. 27, illustrating the sealing member installed in a passage of the slide fastener.
Figure 39:
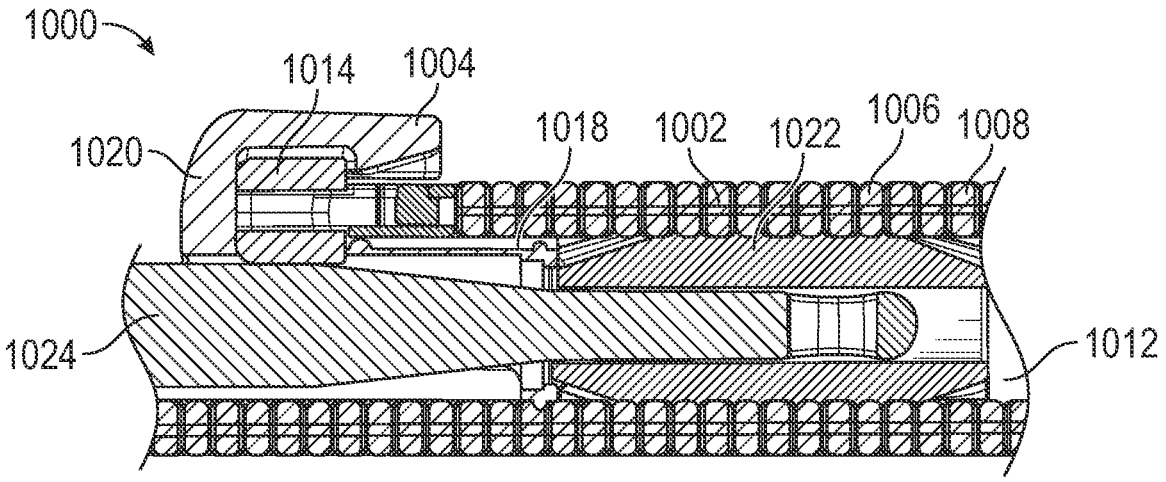
Figure 40:
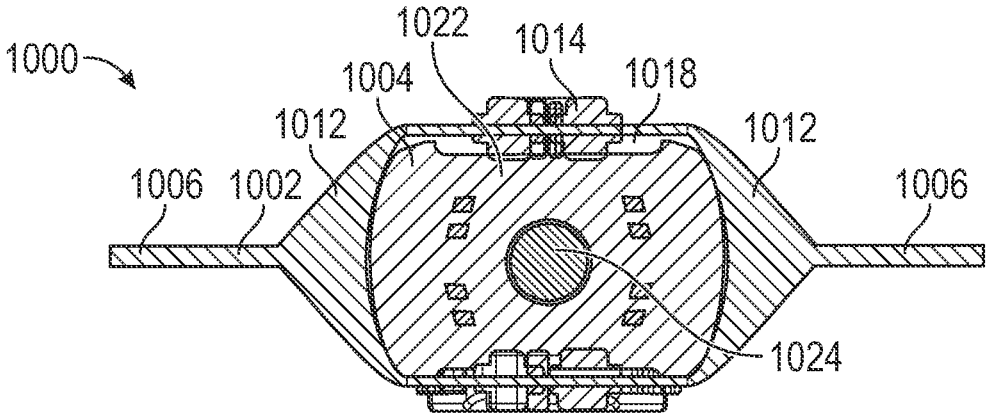
Figure 41:
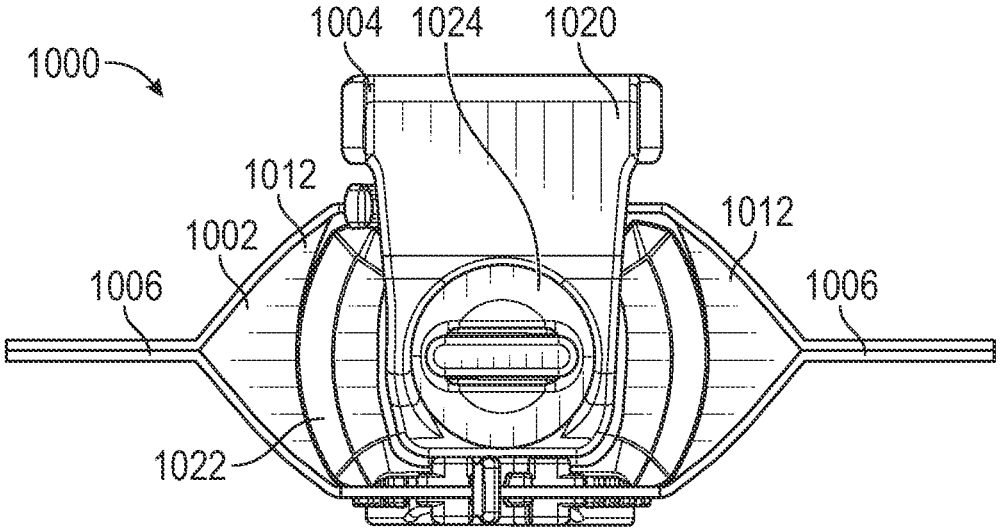

The sealing body actuator 1024 is shown disassociated from the rest of the sealing member 1004 in FIG. 37. As shown in FIG. 37, the sealing body actuator 1024 tapers between a thicker end 1044 and a narrower end 1046. When the thicker end 1044 is moved further into the sealing body 1022, the deformable sealing body 1022 will expand from its base shape to accommodate the thicker end 1044. Conversely, when the narrower end 1046 is moved further into the sealing body 1022, the deformable sealing body 1022 will contract back towards its base shape. It will be appreciated that the deformable sealing body 1022 may not return completely to its base shape when the narrower end 1046 is in the sealing body 1022. The sealing body actuator 1024 shown in FIG. 37 can be connected towards the narrower end 1046 to a pull, such as the tether 325 shown in FIG. 18. The pull may be used to draw the thicker end 1044 of the sealing body actuator 1024 into the sealing body 1022, to deform the sealing body 1022 and cause it to expand. As shown in FIG. 37, the sealing body actuator 1024 includes an aperture 1048 to which the pull may be connected. As also shown in FIG. 37, the sealing body actuator 1024 includes a grip 1050 at its thicker end 1044, which may be used to draw the thicker end 1044 of the sealing body actuator 1024 from the sealing body 1022, causing the sealing body 1022 to contract. The narrower end of actuator 1046 may also extend beyond the end of the sealing body 1022, allowing the actuator 1024 to be pushed to move the narrower end 1046 of the actuator 1024 into the sealing body 1022 to contract the sealing body 1022.

Although not specifically shown in the Figures, the sealing body actuator 1024 and/or the pull connected to the actuator 1024 may be sufficiently long such that it extends beyond the end of the passage 1018 formed by the overlapping ends of the slide fastener 1002 and/or is otherwise accessible from the outside of the garment or other waterproof construct in which the slide fastener sealing system 1000 is being used.

Method of Use

The slide fastener sealing system 1000 of FIGS. 27 to 41 may be used by connecting the sealing member 1004 to an end of the slide fastener 1002, sliding the slide fastener's slider to engage the fastening elements 1008 and close the slide fastener 1002 over the top of the sealing member 1004, and actuating the sealing body actuator 1024 to deform sealing body 1022 such that it expands. Actuating the sealing body actuator 1024 may conform the sealing body 1022 to the side seals 1012 and interiors of the tapes 1006, thereby sealing the passage 1018 to resist fluid penetration therethrough. Actuating the sealing body actuator 1024 may also conform the sealing body 1022 to the elements of the slide fastener, which may form a seal with the elements of the slide fastener to resist fluid penetration therethrough.

FIGS. 38-41 show the sealing member 1004 installed in the passage 1018 of the slide fastener 1002, such that the sealing body 1022 of the sealing member 1004 is adjacent the side seals 1012 of the slide fastener 1002 in a sealing zone of the passage 1018. Both the sealing body 1022 and the side seals 1012 are made of relatively soft, compliant material to facilitate the formation of a fluid-tight seal that plugs the interior of the passage 1018. In one example, the sealing body 1022 includes a material having a Shore hardness in the range of and including OO-30 to Shore D-65, such as a hardness in the range of Shore A-0 to Shore-A 30, such as hardness in the range of and including Shore-A 0 to Shore-A 10. In one non-limiting example, the sealing body 1022 may include a Shore-A 2 elastomeric material. In one example, the side seals 1012 include material having a Shore hardness in the range of and including OO-30 to Shore D-65, such as a hardness in the range of and including Shore-A 30 to Shore-A 90, or in some instances in the range of and including Shore-A 50 to Shore-A 70. The side seals may include a Shore-A 60 urethane material. Shore hardness may be measured, for example, using a durometer and by following the testing procedures set out in ASTM D2240.

Performance

The slide fastener sealing system 1000 of FIGS. 27 to 41 may be relatively impermeable to penetration by fluids, including liquids and/or gasses. The slide fastener 1002 itself may be a waterproof zipper such as, for example, the YKK® AQUASEAL® zipper. As described above, the sealing member 1004 may be used to resist penetration by fluids through a passage 1018 between overlapping ends of the slide fastener 1002 that are secured together to form a passage.

For example, the slide fastener sealing system 1000 may resist fluid penetration at a pressure of at least 1 PSI for 20 seconds. In another example, the slide fastener sealing system 1000 may resist fluid penetration at a pressure of at least 4 PSI for 20 seconds. In another example, the slide fastener sealing system 1000 may resist fluid penetration at a pressure of at least 6.5 PSI for 20 seconds. In another example, the slide fastener sealing system 1000 may resist fluid penetration at a pressure between 1 PSI and 6.5 PSI for 20 seconds. In these examples, the slide fastener sealing system 1000 is resistant to fluid penetration through the slide fastener 1002 itself and through the passage 1018 in which the sealing member 1004 is positioned.

Hydrostatic pressure testing methods may be used to measure resistance to fluid penetration, for instance the hydrostatic pressure testing method set out in Section 7.9 of A-A-55634C Commercial Item Description for Zippers (Fasteners, Slide Interlocking) authorized by the General Services Administration of the United States Federal government (Oct. 30, 2019 version).

Figure 42:
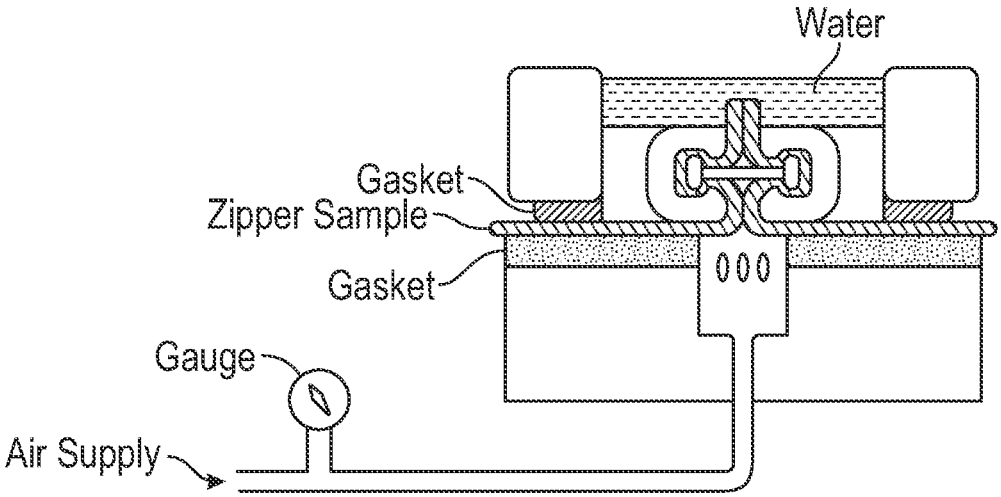
FIG. 42 schematically illustrates an example of a hydrostatic pressure testing method.

FIG. 42 schematically illustrates an example of a hydrostatic pressure testing method. It should be noted that FIG. 42 shows a generic zipper sample, and does not specifically show a slide fastener sealing system including a slide fastener and a sealing member. To test a slide fastener sealing system including a slide fastener and a sealing member, such as the slide fastener sealing system shown in FIG. 27, a length of sample such as what is shown in FIG. 27 may be installed in the testing apparatus of FIG. 42, with the slide fastener in a closed configuration, the sealing member positioned in the passage formed by the overlapping ends of the slide fastener, and the sealing body in an expanded configuration inside the passage. To perform the test, the sample is installed in the testing apparatus such that it is sealed at all of its edges by gaskets, is then immersed in water (e.g. the entire sample is covered to a depth of approximately 1 inch), and is then subjected to air pressure for a certain length of time while the top of the sample is observed for air leaks (e.g. bubbles).

The sealing elements described herein may be constructed from various materials suitable for selectively forming a seal with another component, and the sealing elements are not limited to elastomeric foam. As some non-limiting examples, in other embodiments the sealing elements may be various elastomeric deformable materials, a thermoplastic elastomer, combinations thereof, or other various materials as desired.

While the slide fastener sealing systems described herein are discussed in the context of a waterproof garment, they are by no means so limited. Instead, the slide fastener sealing systems may be used in other applications that may involve liquid and/or potentially harmful gases, including but not limited to boat covers, laboratory suits, bags, cases, and other applications as desired. Moreover, the slide fastener sealing systems may be used in other applications that do not necessarily involve liquid and/or potentially harmful gases.

Illustrations

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A slide fastener sealing system, comprising: (a) a separating slide fastener, comprising: (i) a first tape and a second tape, each tape comprising a first end, a second end, and fastening elements positioned along the tape; and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes; (iii) a slider configured to engage and disengage the fastening elements of the first and second tapes, the first tape being separable from the second tape when the fastening elements are disengaged; and (iv) wherein the sealing zone comprises a passage surrounded on the passage's sides by the first and second tapes; (b) a sealing member, the sealing member configured to be secured to the slide fastener in a removable fashion such that at least a portion of the sealing member is positioned in the sealing zone to seal the passage, the sealing member comprising. (i) a sealing body; (ii) a connector configured to connect the sealing member to the slide fastener; and (iii) a sealing body actuator configured to expand the sealing body.

Illustration 2. The slide fastener sealing system of any preceding or subsequent illustrations or combination of illustrations, the slide fastener further comprising a first side seal located between the first and second ends of the first tape in the sealing zone, and a second side seal located between the first and second ends of the second tape in the sealing zone.

Illustration 3. The slide fastener sealing system of any preceding or subsequent illustrations or combination of illustrations, wherein the connector is configured to connect to the second ends of the first and second tapes.

Illustration 4. The slide fastener sealing system of any preceding or subsequent illustrations or combination of illustrations, wherein the second end of one of the tapes comprises a retaining box, wherein the connector is a resilient hook configured to connect to the retaining box in a removable fashion.

Illustration 5. The slide fastener sealing system of any preceding or subsequent illustrations or combination of illustrations, wherein the sealing member is configured such that when the connector connects the sealing member to the slide fastener, the sealing body is located adjacent the first and second side seals in the sealing zone.

Illustration 6. The slide fastener sealing system of any preceding or subsequent illustrations or combination of illustrations, wherein the sealing body actuator extends through the sealing body in a sliding fashion.

Illustration 7. The slide fastener sealing system of any preceding or subsequent illustrations or combination of illustrations wherein the sealing body actuator comprises a thicker portion configured to expand the sealing body when the thicker portion is slid into the sealing body.

Illustration 8. The slide fastener sealing system of any preceding or subsequent illustrations or combination of illustrations, wherein the sealing body actuator further comprises a pull configured to extend beyond the passageway.

Illustration 9. The slide fastener sealing system of any preceding or subsequent illustrations or combination of illustrations, wherein a material of the sealing body has a Shore hardness in the range of and including OO-30 to Shore D-65.

Illustration 10. The slide fastener sealing system of any preceding or subsequent illustrations or combination of illustrations, wherein a material of the first and second side seals has a Shore A hardness in the range of and including 50 to 70.

Illustration 11. The slide fastener sealing system of any preceding or subsequent illustrations or combination of illustrations, wherein, when the sealing member is positioned in the sealing zone and the fastening elements of the first tape are engaged with the fastening elements of the second tape, the slide fastener sealing system is configured to prevent fluid at a pressure of at least 1 PSI from penetrating through the sealing zone for at least 20 seconds.

Illustration 12. A slide fastener sealing system, comprising. (a) a separating slide fastener, comprising: (i) a first tape and a second tape, each tape comprising a first end, a second end, and fastening elements positioned along the tape; and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes; (iii) a slider configured to engage and disengage the fastening elements of the first and second tapes, the first tape being separable from the second tape when the fastening elements are disengaged; (iv) wherein the sealing zone comprises a passage surrounded on the passage's sides by the first and second tapes; and (v) a first side seal located between the first and second ends of the first tape in the sealing zone, and a second side seal located between the first and second ends of the second tape in the sealing zone; (b) a sealing member, the sealing member configured to be secured to the slide fastener in a removable fashion such that at least a portion of the sealing member is positioned in the sealing zone to seal the passage, the sealing member comprising. (i) a sealing body; and (ii) a connector configured to connect the sealing member to the slide fastener.

Illustration 13. A sealing member for a slide fastener sealing system, the sealing member comprising: (a) a deformable sealing body; (b) a connector attached to the sealing body, the connector comprising a resilient hook configured to connect the sealing member to a slide fastener, and (c) a sealing body actuator configured to deform and expand the sealing body when actuated, wherein the sealing body actuator extends through the sealing body in a sliding fashion.

Illustration 14. The sealing member of any preceding or subsequent illustrations or combination of illustrations, wherein the material of the sealing body has a Shore A hardness in the range of and including 0 to 10.

Illustration 15. A method of sealing a multi-piece article, the method of sealing comprising: (a) fastening together a first piece and a second piece of the multi-piece article with a slide fastener, the slide fastener comprising: (i) a first tape associated with the first piece of the article and a second tape associated with the second piece of the article, each tape comprising a first end, a second end, and fastening elements positioned along the tape, and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes; (b) connecting a sealing member to the slide fastener, the sealing member comprising: (i) a sealing body; (ii) a connector configured to connect the sealing member to the slide fastener; and (iii) a sealing body actuator; and (c) actuating the sealing body actuator to expand the sealing body and seal the sealing zone.

Illustration 16. A slide fastener sealing system, comprising: (a) a slide fastener, comprising: (i) a first and second tape, each tape comprising a first end, a second end, and fastening elements positioned along the tape; and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes; (b) a sealing member, the sealing member configured to be secured to the slide fastener in a removable fashion such that at least a portion of the sealing member is positioned in the sealing zone; (c) wherein, when the sealing member is positioned in the sealing zone and the fastening elements of the first tape are engaged with the fastening elements of the second tape, the slide fastener sealing system is configured to prevent fluid at a pressure of 1 PSI from penetrating through the sealing zone for 20 seconds.

Illustration 17. The slide fastener sealing system of any preceding or subsequent illustrations or combination of illustrations, wherein, when the sealing member is positioned in the sealing zone and the fastening elements of the first tape are engaged with the fastening elements of the second tape, the slide fastener sealing system is configured to prevent fluid at a pressure of 4 PSI from penetrating through the sealing zone for 20 seconds.

Illustration 18. The slide fastener sealing system of any preceding or subsequent illustrations or combination of illustrations, wherein, when the sealing member is positioned in the sealing zone and the fastening elements of the first tape are engaged with the fastening elements of the second tape, the slide fastener sealing system is configured to prevent fluid at a pressure of 6.5 PSI from penetrating through the sealing zone for 20 seconds.

Illustration 19. The slide fastener sealing system of any preceding or subsequent illustrations or combination of illustrations, wherein the slide fastener further comprises a first side seal located between the first and second ends of the first tape in the sealing zone, wherein the slide fastener further comprises a second side seal located between the first and second ends of the second tape in the sealing zone, wherein the first and second side seals each include a material having a Shore A hardness in the range of and including 30 to 90.

Illustration 20. The slide fastener sealing system of any preceding or subsequent illustrations or combination of illustrations, wherein the material of the first and second side seals has a Shore A hardness in the range of and including 50 to 70.

Illustration 21 The slide fastener sealing system of any preceding or subsequent illustrations or combination of illustrations, wherein the sealing member further comprises a sealing body, the sealing body including a material having a Shore A hardness in the range of and including 0 to 30.

Illustration 22. The slide fastener sealing system of any preceding or subsequent illustrations or combination of illustrations, wherein the material of the sealing body has a Shore A hardness in the range of and including 0 to 10.

Illustration 23. The slide fastener of any preceding or subsequent illustrations or combination of illustrations: wherein the slide fastener further comprises a first side seal located between the first and second ends of the first tape in the sealing zone, wherein the slide fastener further comprises a second side seal located between the first and second ends of the second tape in the sealing zone, wherein the first and second side seals each include a material having a Shore A hardness in the range of and including 30 to 90; and wherein the sealing member further comprises a sealing body, the sealing body including a material having a Shore A hardness in the range of and including 0 to 30.

Illustration 24. The slide fastener of any preceding or subsequent illustrations or combination of illustrations, wherein the slide fastener comprises a separating slide fastener.

The above description is provided only to describe several non-limiting examples of slide fastener sealing systems and related methods. Additions, deletions, substitutions, and other modifications can be made to the slide fastener sealing systems and related methods without departing from the scope or the spirit of the inventions claimed by this and related patents. In other words, the above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A slide fastener sealing system, comprising:

(a) a separating slide fastener, comprising:

(i) a first tape and a second tape, each tape comprising a first end, a second end, and fastening elements positioned along each tape; and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes;

(iii) a slider configured to engage and disengage the fastening elements of the first and second tapes, the first tape being separable from the second tape when the fastening elements are disengaged; and (iv) wherein the sealing zone comprises a passage surrounded on the passage's sides by the first and second tapes;

(b) a sealing member, the sealing member configured to be secured to the slide fastener in a removable fashion such that at least a portion of the sealing member is positioned in the sealing zone to seal the passage, the sealing member comprising:

(i) a sealing body;

(ii) a connector configured to connect the sealing member to the slide fastener; and (iii) a sealing body actuator configured to expand the sealing body.

2. The slide fastener sealing system of claim 1, the slide fastener further comprising a first side seal located between the first and second ends of the first tape in the sealing zone, and a second side seal located between the first and second ends of the second tape in the sealing zone.

3. The slide fastener sealing system of claim 2, wherein the connector is configured to connect to the second ends of the first and second tapes.

4. The slide fastener sealing system of claim 3, wherein the second end of one of the tapes comprises a retaining box, wherein the connector is a resilient hook configured to connect to the retaining box in a removable fashion.

5. The slide fastener sealing system of claim 3, wherein the sealing member is configured such that when the connector connects the sealing member to the slide fastener, the sealing body is located adjacent the first and second side seals in the sealing zone.

6. The slide fastener sealing system of claim 2, wherein the sealing body actuator extends through the sealing body in a sliding fashion.

7. The slide fastener sealing system of claim 6, wherein the sealing body actuator comprises a thicker portion configured to expand the sealing body when the thicker portion is slid into the sealing body.

8. The slide fastener sealing system of claim 6, wherein the sealing body actuator further comprises a pull configured to extend beyond the passage.

9. The slide fastener sealing system of claim 2, wherein a material of the sealing body has a Shore hardness in the range of and including OO-30 to Shore D-65.

10. The slide fastener sealing system of claim 2, wherein a material of the first and second side seals has a Shore A hardness in the range of and including 50 to 70.

11. The slide fastener sealing system of claim 2, wherein, when the sealing member is positioned in the sealing zone and the fastening elements of the first tape are engaged with the fastening elements of the second tape, the slide fastener sealing system is configured to prevent fluid at a pressure of at least 1 PSI from penetrating through the sealing zone for at least 20 seconds.

12. A slide fastener sealing system, comprising:

(a) a separating slide fastener, comprising:

(i) a first tape and a second tape, each tape comprising a first end, a second end, and fastening elements positioned along each tape; and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes;

(iii) a slider configured to engage and disengage the fastening elements of the first and second tapes, the first tape being separable from the second tape when the fastening elements are disengaged;

(iv) wherein the sealing zone comprises a passage surrounded on the passage's sides by the first and second tapes; and (v) a first side seal located between the first and second ends of the first tape in the sealing zone, and a second side seal located between the first and second ends of the second tape in the sealing zone;

(b) a sealing member, the sealing member configured to be secured to the slide fastener in a removable fashion such that at least a portion of the sealing member is positioned in the sealing zone to seal the passage, the sealing member comprising:

(i) a sealing body; and (ii) a connector configured to connect the sealing member to the slide fastener.

13. A sealing member for a slide fastener sealing system, the sealing member comprising:

(a) a deformable sealing body;

(b) a connector attached to the sealing body, the connector comprising a resilient hook configured to connect the sealing member to a slide fastener, and (c) a sealing body actuator configured to deform and expand the sealing body when actuated, wherein the sealing body actuator extends through the sealing body in a sliding fashion.

14. The sealing member of claim 13, wherein a material of the sealing body has a Shore A hardness in the range of and including 0 to 10.

15. A method of sealing a multi-piece article, the method of sealing comprising:

(a) fastening together a first piece and a second piece of the multi-piece article with a slide fastener, the slide fastener comprising:

(i) a first tape associated with the first piece of the article and a second tape associated with the second piece of the article, each tape comprising a first end, a second end, and fastening elements positioned along each tape; and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes;

(b) connecting a sealing member to the slide fastener, the sealing member comprising:

(i) a sealing body;

(ii) a connector configured to connect the sealing member to the slide fastener; and (iii) a sealing body actuator; and (c) actuating the sealing body actuator to expand the sealing body and seal the sealing zone.

16. A slide fastener sealing system, comprising:

(a) a slide fastener, comprising:

(i) a first and second tape, each tape comprising a first end, a second end, and fastening elements positioned along each tape; and (ii) wherein the first end of the first tape overlaps and is secured to the second end of the first tape, wherein the first end of the second tape overlaps and is secured to the second end of the second tape, wherein a sealing zone is located between the overlapping ends of the first and second tapes;

(b) a sealing member, the sealing member configured to be secured to the slide fastener in a removable fashion such that at least a portion of the sealing member is positioned in the sealing zone;

(c) wherein, when the sealing member is positioned in the sealing zone and the fastening elements of the first tape are engaged with the fastening elements of the second tape, the slide fastener sealing system is configured to prevent fluid at a pressure of 1 PSI from penetrating through the sealing zone for 20 seconds.

17. The slide fastener sealing system of claim 16, wherein, when the sealing member is positioned in the sealing zone and the fastening elements of the first tape are engaged with the fastening elements of the second tape, the slide fastener sealing system is configured to prevent fluid at a pressure of 4 PSI from penetrating through the sealing zone for 20 seconds.

18. The slide fastener sealing system of claim 17, wherein, when the sealing member is positioned in the sealing zone and the fastening elements of the first tape are engaged with the fastening elements of the second tape, the slide fastener sealing system is configured to prevent fluid at a pressure of 6.5 PSI from penetrating through the sealing zone for 20 seconds.

19. The slide fastener sealing system of claim 17, wherein the slide fastener further comprises a first side seal located between the first and second ends of the first tape in the sealing zone, wherein the slide fastener further comprises a second side seal located between the first and second ends of the second tape in the sealing zone, wherein the first and second side seals each include a material having a Shore A hardness in the range of and including 30 to 90.

20. The slide fastener sealing system of claim 19, wherein the material of the first and second side seals has a Shore A hardness in the range of and including 50 to 70.

21. The slide fastener sealing system of claim 17, wherein the sealing member further comprises a sealing body, the sealing body including a material having a Shore A hardness in the range of and including 0 to 30.

22. The slide fastener sealing system of claim 21, wherein the material of the sealing body has a Shore A hardness in the range of and including 0 to 10.

23. The slide fastener of claim 17:

wherein the slide fastener further comprises a first side seal located between the first and second ends of the first tape in the sealing zone, wherein the slide fastener further comprises a second side seal located between the first and second ends of the second tape in the sealing zone, wherein the first and second side seals each include a material having a Shore A hardness in the range of and including 30 to 90; and wherein the sealing member further comprises a sealing body, the sealing body including a material having a Shore A hardness in the range of and including 0 to 30.

24. The slide fastener of claim 23, wherein the slide fastener comprises a separating slide fastener.

* * * * *